US005096155A

United States Patent [19]

Fitzgerald

[11] Patent Number: 5,096,155

[45] Date of Patent: Mar. 17, 1992

[54] CONCRETE FORM SUPPORTING BRACKET

[76] Inventor: Leonard R. Fitzgerald, 2659 Pacific Highway Eight Mile Plains, Brisbane, Queensland 4123, Australia

[21] Appl. No.: 539,587

[22] Filed: Jun. 18, 1990

Related U.S. Application Data

[63] Continuation-in-part of Ser. No. 249,380, Sep. 26, 1988, abandoned, which is a continuation-in-part of Ser. No. 87,160, Aug. 19, 1987, Pat. No. 4,846,437.

[51] Int. Cl.[5] ..... E04G 17/14; E01C 19/50

[52] U.S. Cl. ..... 249/219.1; 248/156; 249/3; 249/208; 403/374

[58] Field of Search ..... 249/2-9, 249/14, 34, 208, 219.1; 425/59; 403/108, 104, 347, 374, 379, 393, 397; 248/156, 351, 545

[56] References Cited

U.S. PATENT DOCUMENTS

| | | | |
|---|---|---|---|
| 895,475 | 8/1908 | LaDow | 403/374 |
| 1,644,586 | 10/1927 | Heltzel | 249/5 |
| 1,644,587 | 10/1927 | Heltzel | 249/5 |
| 1,672,760 | 6/1928 | Heltzel | 249/6 |
| 3,108,828 | 10/1963 | Kus | 403/397 |
| 3,208,777 | 9/1965 | Maslow | 403/397 |
| 3,288,426 | 11/1966 | Simpson | 249/5 |
| 4,846,437 | 7/1989 | Fitzgerald | 249/6 |

*Primary Examiner*—James C. Housel
*Attorney, Agent, or Firm*—Aquilino & Welsh

[57] ABSTRACT

A form supporting bracket for supporting a concrete form on a support surface, including a form-engaging member having a base plate with an aperture therein. A rod extends through the aperture for preventing lateral movement, and a clamp secures the base plate to the rod for preventing angular movement. The clamp includes a rigid angle member with one leg having an aperture therethrough for engaging the rod while the other leg engages the base plate.

4 Claims, 26 Drawing Sheets

FIG. 16
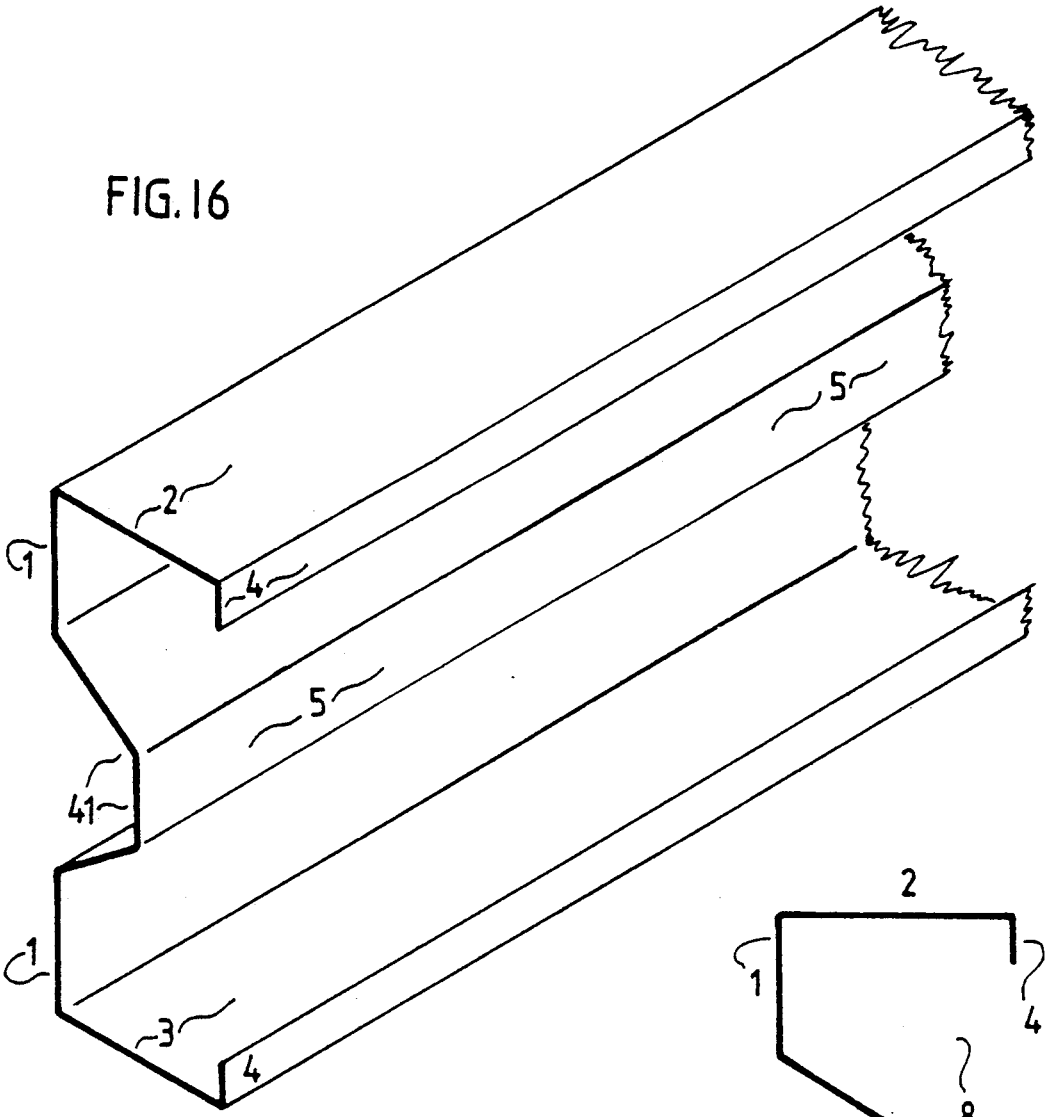
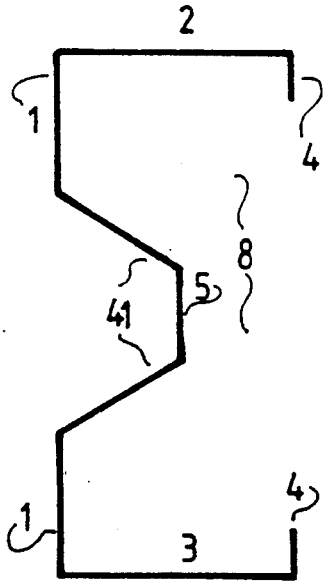
FIG. 17

FIG. 18
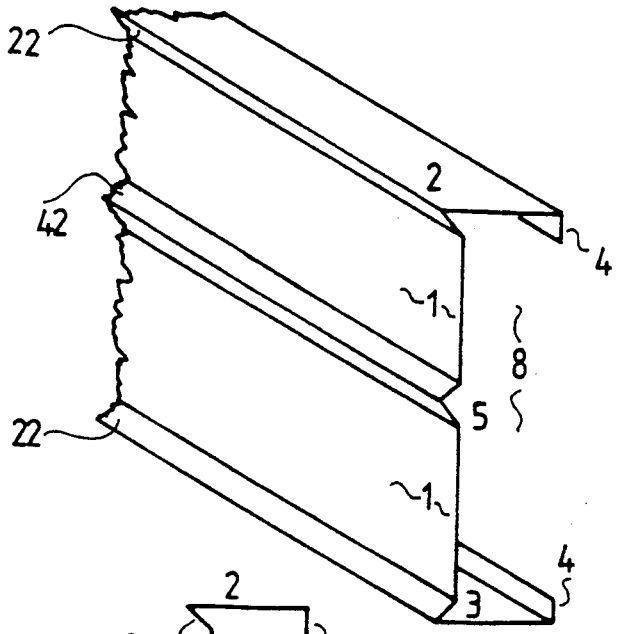
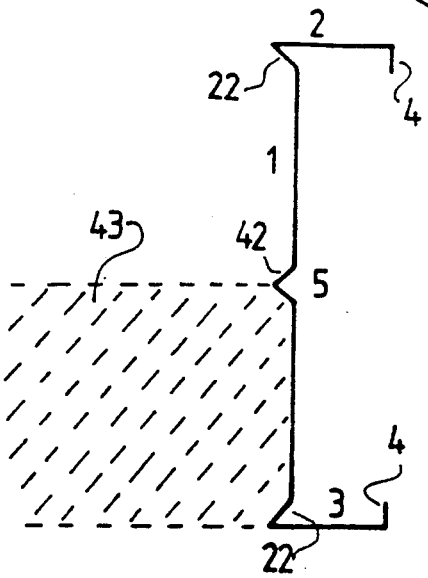
FIG. 19

FIG. 22
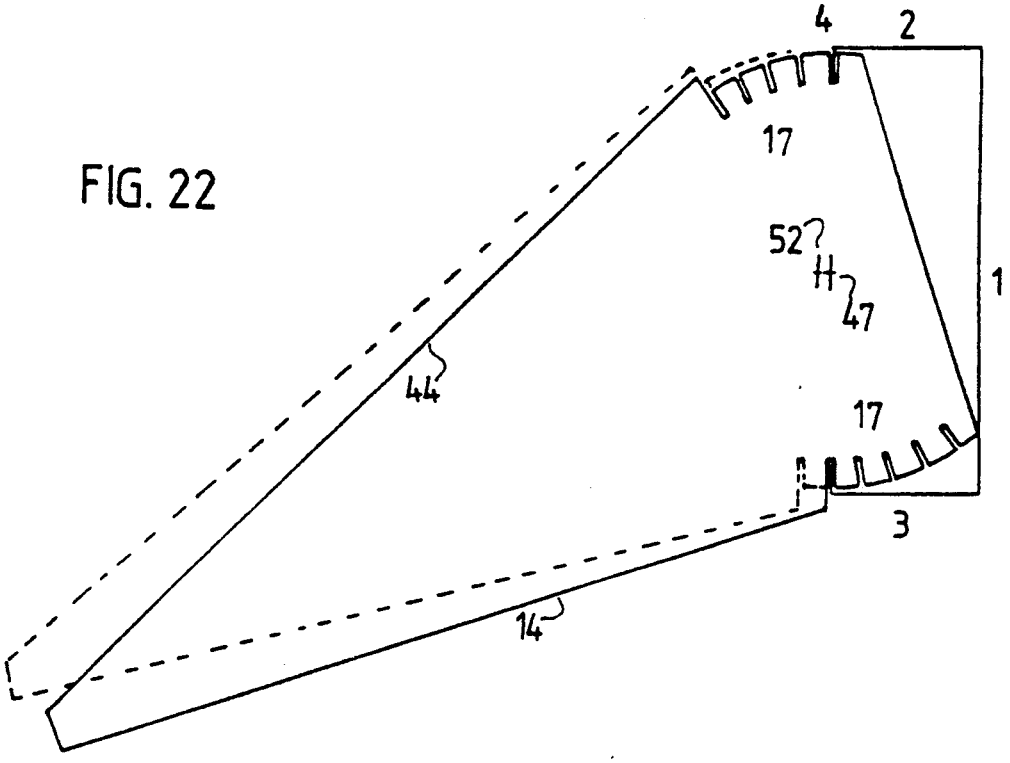
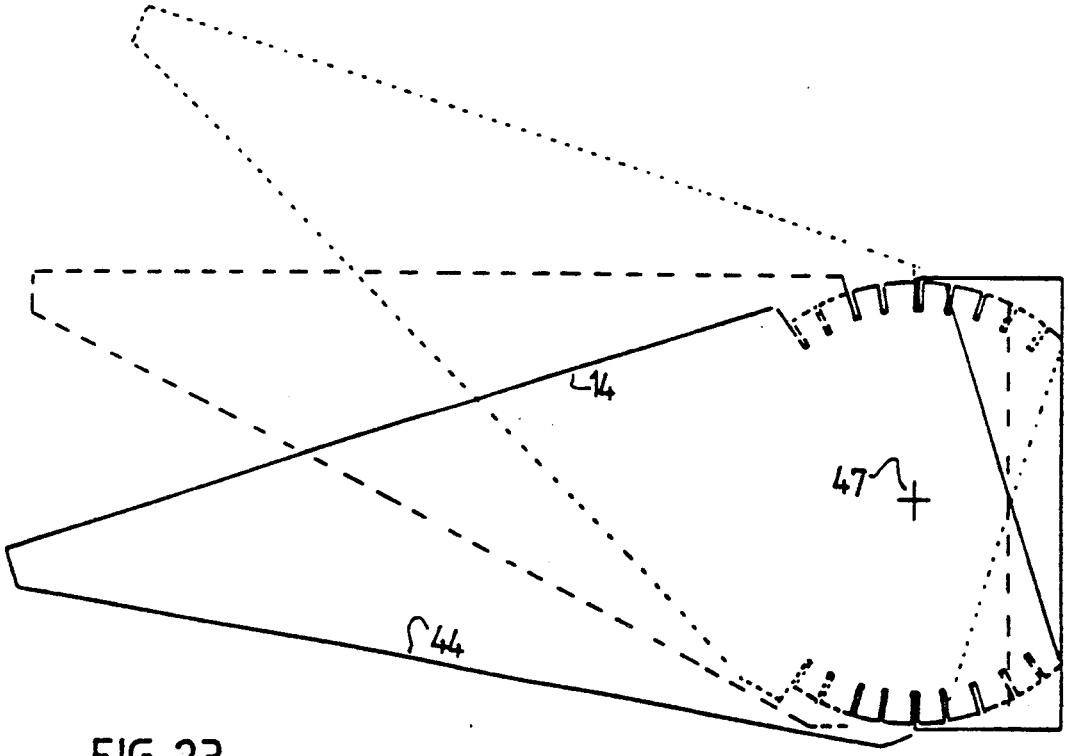
FIG. 23

FIG.37
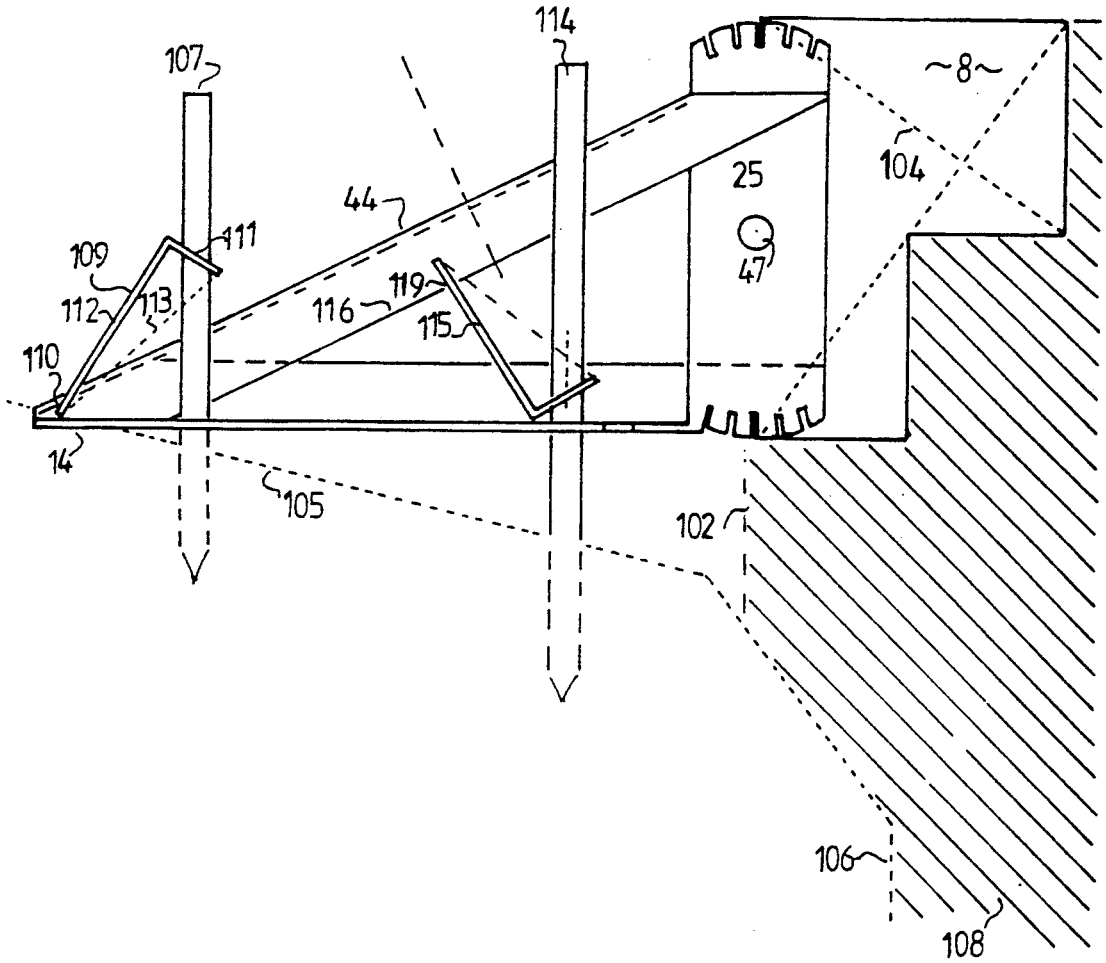
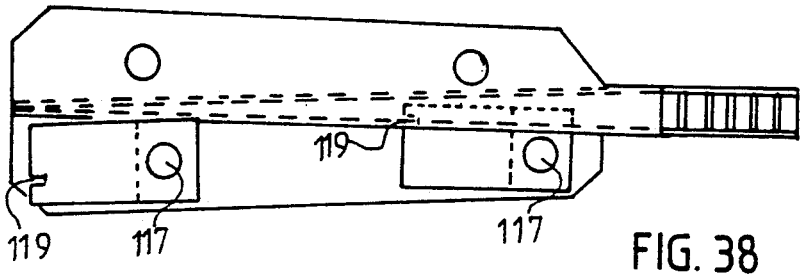
FIG. 38

CONCRETE FORM SUPPORTING BRACKET

This application is a continuation-in-part of patent application entitled "Lipped Channel Formwork", ser. no. 07/249,380 filed Sept. 26th, 1988, and now abandoned, which is a continuation-in-part of patent application entitled "Bracket For Supporting Concrete Form work", Ser. No. 07/087,160 filed Aug. 19, 1987, and now U.S. Pat. No. 4,846,437.

BACKGROUND OF THE INVENTION

This invention concerns building and concrete construction generally, and, as a particular example of the use of rod clamps, the clamping or locking in position of formwork supports on rod-like subgrade anchors.

Generally, time and motion observations of erection and stripping of braced or stayed formwork have suggested that although semi-permanent, threaded, metal-to-metal connection means such as nuts and bolts, Allen screws, wingnuts and the like may be advantageously used in place of welding to hold sub-parts of formwork support assemblies together, when such joining means are used to make repetitive connections in the field, such as those between forms and formwork supports, on-site assembly and stripping of said formwork becomes noncompetitive with timber methods, at least partly because of the rapidity and convenience of nail-fixing. It is proposed therefore, that threaded joining means (nuts, bolts, screws and the like) be reserved for connections not routinely pulled apart in the field, and that new application of rapid-cycling metal-to-metal connections be used for repetitive joining of formwork components on site.

Rotating actioned form supports are described in some detail to give perspective, particular applications of such rod clamps and derivation of terminology.

From weapons technology a suitably simple, robust and well known example is the century-old Mauser rifle action wherein a pair of forward mounted locking lugs, monolithic or one-piece with a multifunctional firing pin carrier or "bolt" capable of rotation about an axis orthogonal to the major plane of the "bolt-face" are inserted—at a particular arrested alignment of said rotation—through a "gate" into a housing or receiver, the latter being mounted rearward of, but functionally monolithic with the barrel; then the pair of locking lugs are caused to rotate (most commonly, forty-five degrees clockwise) within the housing and away from the gate alignment to the locked-action position. Advantages of such a connection in metal formwork applications include; speed, as such a connection can be made and broken considerably faster than nail fixing/extraction, and security, as a force acting orthogonally against either the plane of the "bolt" face or form face has virtually no vector component (in parallel planes such as a theoretical rotational plane of centre-line of locking lugs) acting to unlock the assembly.

SUMMARY OF THE INVENTION

The objects of this invention include causing metal formwork—especially tilt-up and slab formwork—to be cost competitive with timber via increasing the metal forms' versatility, support erection and dismantling speed, and decreasing manufacturing, transport, storage and general on-site handling costs, by providing in conjunction with rod clamp and ground anchor assembly, a cheaply manufactured, nestable, removeable, self-plumbing, threadless form support capable of engaging light-gauge, easily cut, pressed or roll-formed metal forms at virtually any point along their length.

Other and further objects of this invention will be pointed out hereinafter or will be indicated in the appended claims or will be obvious to any skilled in the art upon an understanding of this disclosure.

According to one aspect of the invention, there is provided a supportive casting floor (the reference plane) of earth concrete or other material for purposes of supporting fluid concrete; the latter whilst uncured, is retained at edges of specified dimensions defined by oblong edge forms or moulds adapted to be located and retained on said floor by two or more edge form support brackets adapted to be mounted in spaced relationship on said floor and connected to the non-pour side of each edge-form, the latter having bracket-attachment means along its non-pour side while each bracket has at the forward end thereof edge-form attachment means adapted to be engaged rigidly but releasably with said bracket-attachment means of said edge form, the other end of each bracket having means whereby it may be secured releasably to said floor when the bracket is operatively connected to said edge form.

The simplest and cheapest embodiment of said edge form is a more or less light-gauge, lipped channel metal section, whose profile of web, flanges and lips, when seated on a casting floor or reference plane and viewed at a transverse section suitable for bracket engagement, includes monolithically a substantially vertical suitably profiled, concrete forming mould face (the web) the top and bottom of which are each provided with a monolithically connected flange (that is, the flange is extendent from mould face) or stiffening element projecting rearwardly away from intended position of the fluid concrete. Each said flange is provided with a monolithically connected lip (that is, lip extends from flange) whereby the major planes of said lips are most commonly parallel with the major plane of said mould face and with each other and the free edge of each lip projects toward a horizontal plane (parallel with the reference plane) located between said lip edges whereby the vertical distance between said free edges of the lips is less than the vertical dimension between said flanges thereby creating an integral lipped cavity or lipped housing or receiver on the non-pour side of said mould-face serving in conjunction with said lips as bracket attachment means of said edge form. Further, the invention does not require the planes of said lips to be parallel with said mould face nor be coplanar with each other. However, the invention does require the planes of the centrelines of said lips to be substantially parallel with each other, thereby allowing lip-housing slots provided in forward-mounted edge-form attachment part of each bracket to engage/disengage said lips—via rotation of said bracket about an axis orthongular to planes of centrelines of said lips when the centreline of each lip-housing slot is in the same plane as the centreline of its relevant lip—during the process of connecting/disconnecting said bracket with/from the lipped cavity or housing on the non-pour side of the edge form. Although said forward mounted edge form attachement means is slideable along an unobstructed lipped cavity such slideable engagement is not the intended engagement method because said lipped cavity may be accidentally or purposefully discontinuous due to dents, encrusted concrete, protruding dowels, conduit or reinforcement (whether of slab or of form) and the like.

An effective, simple, and cheaply manufactured embodiment of the form support bracket for tilt-up and general slab work is manufactued from sheet metal, is more or less "L" shaped in central transverse section(-rearward of the forward mounted lip housing slots), is functionally monolithic in use and preferably of rigid one-piece construction incorporating a forward mounted edge form attachement means comprising lip retaining lugs and lip housing slots wherein said edge form attachment means is more or less coplanar (or at least functionally monolithic) with and stayed to a casting floor anchorable baseplate by a gusset-like body part (the latter appearing as the vertical bar and the former the horizontal bar of the "L" shape in described transverse section) wherein said base plate contains suitably clearanced holes whereto may be fitted appropriate fixing or anchor means to said casting floor when said bracket is operatively connected to said edgeform. By way of illustration, during casting of tilt-up concrete wall panels appropriate anchor means to a concrete casting floor include quarter-inch (6 mm) diameter rawlplugs or equivalent and for slab-on-grade casting, three-quarter inch (19 mm) diameter steel pegs, dowel bars or equivalent.

During concrete placement and compaction, live loads (due to head of concrete plus vibrating compaction equipment) generally acting orthogonally to the major plane of the edge form mould face, are transferred via the gusset or stayed body part of the bracket (when assembly of edge form and support bracket is operatively connected) to the baseplate and baseplate anchor means whereupon said load is reacted by the casting floor (or subgrade as the case may be). Because said baseplate is virtually incompressible and either well seated on, or at least close to said casting floor, the described load transfer through said gusset result in a much shorter lever arm and thereby a smaller moment of any given load is required to be reacted by the casting floor or subgrade than would be the case where said given load is afforded a longer lever arm by being applied higher up on the anchor means and therefore further from the fulcrum point in the casting floor.

Mould faces of end-butted adjoining edge forms may be retained in alignment by use of a support bracket incorporating a forward mounted alignment flange. Im consideration of simlified manufacturing and stacking (nesting) characteristics of said brackets, said alignment flange may be constructed by folding a continuation of the sheet metal of the forward lip retaining lugs into a flange more or less orthogonal to the plane of the gussetted body part and lip retaining lugs of the support bracket whereupon when said bracket is operatively connected with the lipped cavity on the non-pour side of one form, said alignment flange bears against the rear of the mould face of that form and the rear of the mould face of the end-butted adjoining form. In tilt-up casting, one or both of the free corners of said alignment flange may be "backed-off" whereby said alignment bracket may be engaged or disengaged with end-butted adjoining forms without disturbing the position of the latter when they are in specified location on casting floor. Generally, when the assembly of edge form and support brackets is operative, fore and aft movement of edge forms is controlled by operative fore and aft lip retaining lugs incorporated in forward edge form attachment means of support bracket whilst vertical movement of edge form is controlled by depth of engaged lip-housing slot and/or by operative fore-lug housed in the lipped cavity. In practice, there may be a slight clearance betweem fore-lug and inner side of edge form flange due to manufacturing or wear tolerances, however, upon any untoward vertical movement of edge form during concrete placement (it is best if said clearance is small) there is almost immediate bearing between said flange and said housed operative fore-lug.

During the casting of certain structures (as for example, sequential stack-casting of tilt-up wall panels) where it is desirous to use thin, easily cut sheet metal edge forms (of the type described above) in excess of 300 mm height of mould face, it may be necessary to support the rear of the mould face at least centrally to avoid rearward deflection in the region of the central longitudinal axis of the mould face. Uncontrolled bowing under these conditions (very thin form material and high unsupported loads) may cause lips to disengage from lip housing slots. Use of an alignment flanged support bracket, as described, will eliminate most of these types of problems. In the extreme it may be necessary to provide fixed vertical bars as reinforcement to the inside of the lipped cavity of the edge form whereby lips are held in desired relationship and/or mould face is stiffened vertically. Such reinforcement should not cause any problems with engagement of described support brackets as the latter were designed to circumvent problems caused by discontinuity of the lipped cavity of the edge form.

Provided said deflection along the central longitudinal axis of the mould face is counteracted as described, there is virtually no vector component of fluid concrete or vibrational load acting to unlock the rotational engagement of support bracket with edge form. Further, when said rotational engagement is enacted during form assembly and the base plate of the support bracket is seated on and fixed via anchor means to the tilt-up casting floor as described hereinafter, the action is effectively locked in that support position because said bracket is of unit construction and locking its base plate stops rotation about any axis (short of failure of anchor means).

With the foregoing in mind, those skilled in the art will appreciate that in the simplest case, casting of tilt-up concrete panels, the inventive method consists of establishing the dimensions of a required to-be-cast panel on a flat casting floor—whilst allowing for horizontal dimension of integral chamfer strip or fillet if said chamfer strip is incorporated in the mould face of the described appropriately sized edge form—arranging edge-form(s) to suit said dimensions with said mould face(s) creating the external outline of said panel and lipped cavity facing rearwardly—away from intended position of fluid concrete—thereby allowing engagement (via insertion and rotation) of appropriately sized form support brackets with said lipped cavity at suitable unobstructed places along said cavity; in the case of the most common (150 mm) thickness of tilt-up panels, said brackets would be spaced up to about a meter apart. Where edge forms are end-butted on a continuous line, alignment brackets may be used at the join, with the next bracket along being used to pull the loose edge-form back onto the alignment flange. Once the assembly of edge-form and support bracket(s) has been made, positioning of edge-form is rechecked and the base plate of said bracket is fixed to the casting floor by the cheapest, fastest and most appropriate anchor means, which, in the case of a concrete casting floor, generally involves inserting the bit of a masonry drill through appropriate (one fore, and one aft) holes provided in said base plate (said holes are offset from the gusset or main body part of said bracket to allow free operation of the chuck and motor or body of said drill) and, using said fore and aft base plate holes as drill guides, drilling the pair of more or less quarter-inch diameter holes in the concrete casting floor whilst holding edge-form in correct position by, for example, the drill operator putting one boot on the bottom flange of the edge form and the other on the middle (not anchored) section of the support bracket base plate. A cheap method of providing a rawlplug-type fixing is to insert a plastic tube through said base plate hole to the bottom of the recently drilled hole in the casting floor, cut said tube off just above said base plate, then drive a 3.75 by 75 mm bullet-head wire nail into the centre of the now plastic-lined hole, forcing expansion of said plastic against side walls of the concrete hole then folding the head of said nail forward toward the concrete pour. Upon stripping or dismantling of the edge form assembly, it is often found said nails and plastic tubes (upon extraction) may be re-used, whereas proprietary rawlplug type fixings break up.

In order that those skilled in the art may understand better the practical application, import and arrangement of the principles underlying the invention, I have elected to show herein certain forms and details of formwork and formwork supports which are representative of the invention; it is to be understood, however, that the embodiment of the invention herein shown and described is for purposes of illustration only and that therefore it is not to be regarded as exhaustive.

BRIEF DESCRIPTION OF THE DRAWINGS

Particular embodiments of the invention will now be described with reference to the accompanying drawings wherein:

FIG. 16 shows a pictorial view of a lipped channel edge form with a mould-face suitably profiled to produce the male side of a shear-key profile in cast concrete.

FIG. 17 shows a transverse section of the edge form shown in FIG. 16.

FIG. 18 shows a pictorial view of a self-chamfering lipped channel edge form suitable for use in stack-casting of tilt-up wall panels.

FIG. 19 shows a transverse section of the edge form shown in FIG. 18, also depicting level of cast concrete in the lower stack-cast slab.

FIG. 22 shows superimposed transverse sections of an edge form support bracket (of the type seen in FIG. 20) engaged with a lipped channel edge form, depicting the variation in angle between edge form mould face and support bracket base plate flange obtained by varying operatively connected lip housing slots.

FIG. 23 shows superimposed transverse sections of an edge form support bracket (of the type seen in FIG. 21) engaged with a lipped channel edge form, depicting the variation in angle between edge form mould face and support bracket base plate flange obtained by varying operatively connected lip housing slots in conjunction with inversion of the support bracket and thereby use of the (previously) top-mounted inclined flange as base plate.

FIG. 24 shows a pictorial view of a double-ended edge form support bracket suitable for use in construction of box-drains tilt-up casting and the like.

FIG. 37 shows a transverse section on part of tilt-up wall footing cast against cantilevered one-piece corbelled formwork wherein support thereof is provided by a form support bracket (seen in side elevation) in conjuction with use of rod clamps engaging ground spike rods the latter acting as subgrade anchors.

FIG. 38 shows a plan view of arrangement of bracket and rod clamps seen in previous elevation.

DETAILED DESCRIPTION OF PREFERRED EMBODIMENTS

Figure 1:
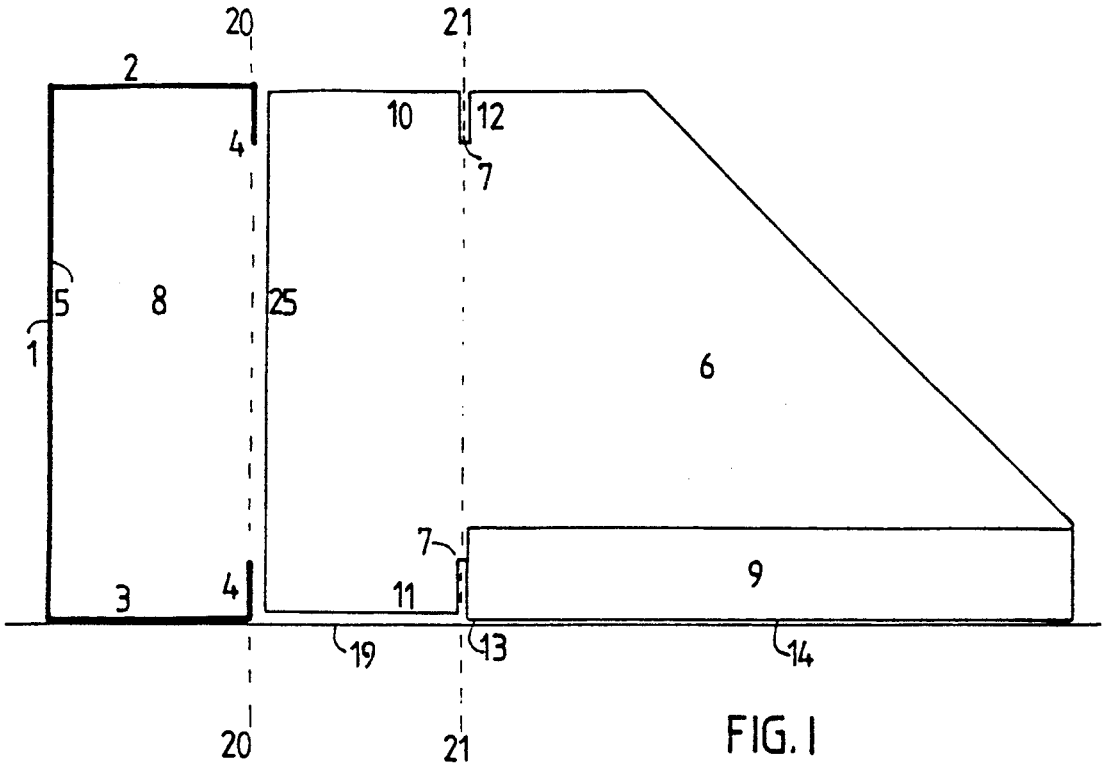
FIG. 1 shows a ready-for assembly side view of an embodiment of the invention, disassembled and seated on a flat casting floor or reference plane whereby, on the left, a lipped channel edge form is seen at a transverse section suitable for bracked engagement whilst on the right a self-plumbing edge form support bracket is seen in side elevation.

Referring to the drawings, the numeral 1 designates the edge form mould face, said edge form in FIG. 1 being seen on the left in transverse section, at a point suitable for connection with a self-plumbing, removable support bracket, the latter being seen on the right, in side elevation. In this simplest edge form embodiment, top and bottom edge form flanges (2 and 3, respectively) extend rearwardly from mould face and are provided with lips 4 whose free edges project toward each other thereby creating a lipped cavity 8, acting as a lipped housing or receiver for the top fore-lug 10 and bottom fore-lug 11 of the support bracket. Said fore-lugs 10 and 11 are separated from their respective aft lugs at top 12 and bottom 13 (the latter is obscured in FIGS. 1 and 2 by base plate flange stiffening lip 9) by lip housing slots 7. Said aft lugs 12 and 13 are continuous in this embodiment with gussetted body part 6 of support bracket. In FIG. 1 the centreline of the major plane of edge form lips 4 is shown by a broken, substantially vertical line 20—20. The centreline of support braket lip housing slots 7 is represented by broken line 21—21 the latter being orthongular to support bracket base plate flange 14 (obscured) in this self-plumbing embodiment. Since base plate flange 14 is seated on the reference plane of the casting floor 19 and said plane is, in tilt-up casting, normally flat and level, it follows that centreline 21—21 in orthongular to casting floor 19 and that when the widths of edge form flanges 2 and 3 are equal and when edge form lips 4 are housed in support bracket lip housing slots 7 thereby causing centrelines 20—2—and 21—21 to be more or less coplanar—as seen in FIG. 2 wherein edge form and support bracket are operatively connected—edge form mould face 1 is automatically plumbed.

Figure 2:
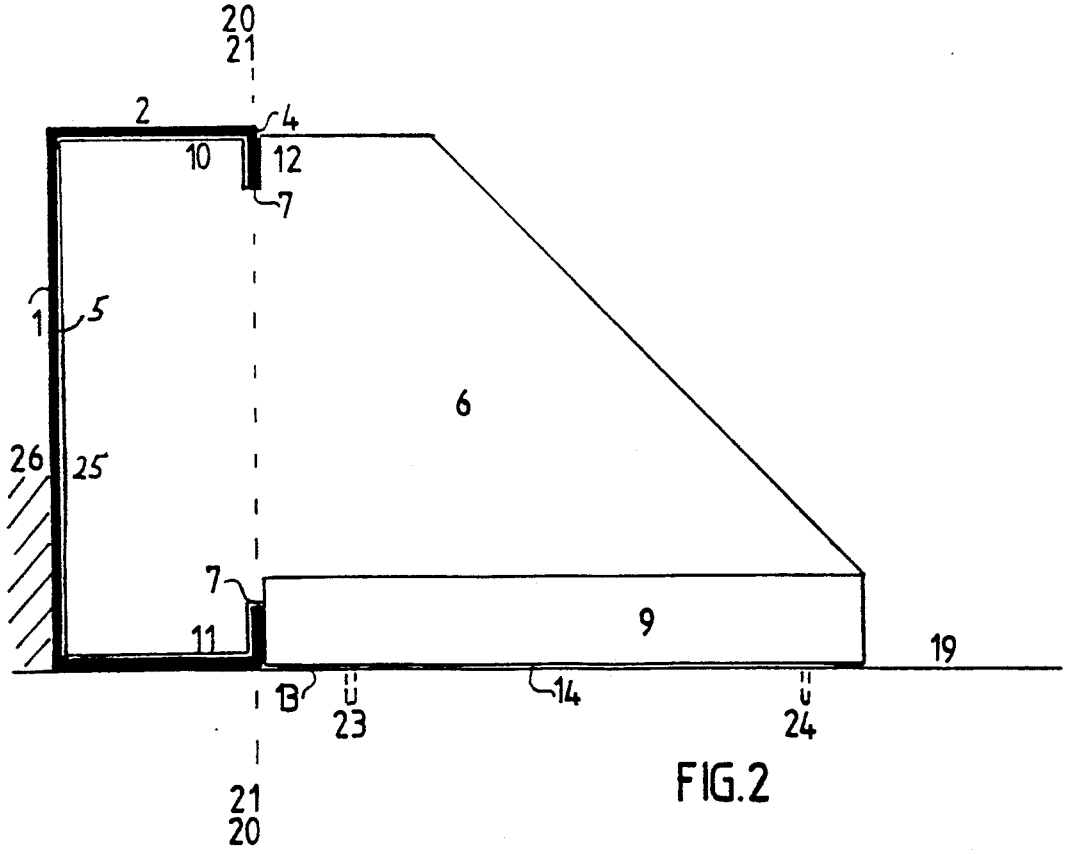
FIG. 2 shows a side view of the equipment seen in FIG. 1 after assembly.

Rear side 5 of edge form mould face 1 is supported in this embodiment by lugged forepart 25 of support bracket when equipment shown in FIG. 1 is operatively connected as seen in FIG. 2. Load due to fluid concrete 26 acting more or less orthongular to mould face 1 is transferred through gussetted body part 6 to base plate 14 and fore and aft anchor means 23 and 24 whereupon said load is reacted by casting floor 19.

Fore and aft movement of edge form is controlled generally by lip retaining lugs 10, 11, 12 and 13, and, in this particular case, deflection of mould face 1 along its central longitudinal axis is controlled by forepart 25 of support bracket, whilst vertical movement of edge form is controlled by depth of lip housing slots 7 and extent of fore lugs 10 and 11. In many applications support of rear of mould face 5 by support bracket forepart 25 is not necessary, but said support is required when using thin steel edge form material whose thickness is less than 1.0 millimetres (0.04 inch) and depth of vibrated fluid concrete supported by edge form is 300 mm (12 inches) or more. Where support bracket body 6 and base plate flange 14 are constructed of relatively thin sheet metal—for example steel sheet whose thickness is 2.5 mm (0.1 inch) or less,—base plate flange 14 is preferably lipped 9 to avoid distortion in base plate 14 which could cause problems with self or automatic plumbing feature during assembly to tilt-up formwork. During said tilt-up slab casting support bracket base plate is held securely to casting slab by fore 23 and aft 24 anchor means fitted to smaller base plate holes 15 seen clearly in the following figure.

Figure 3:
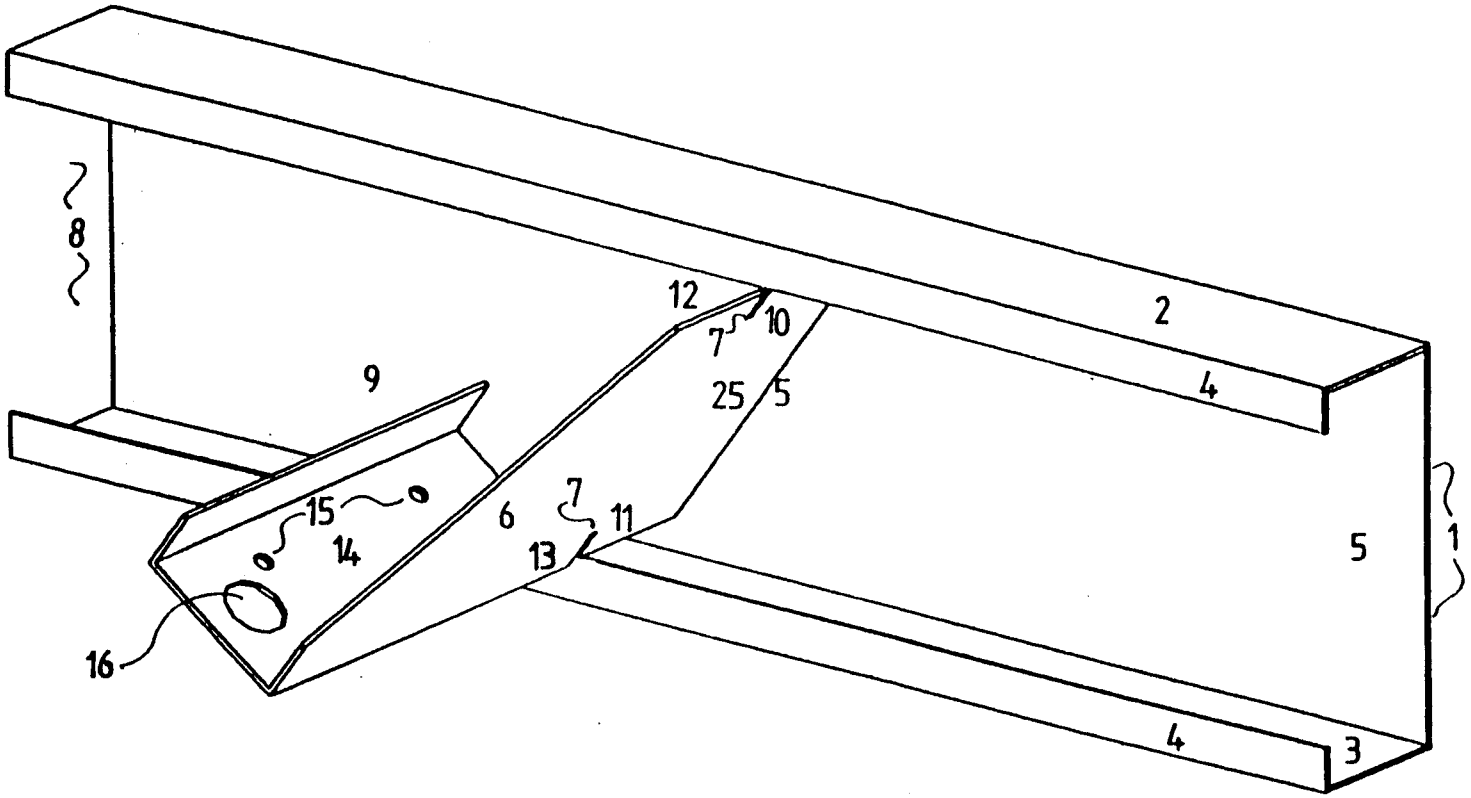
FIG. 3 shows a pictorial view of an intermediate step in assembly of the equipment seen in FIG. 1.

FIG. 3 shows a particular arrested alignment of support bracket fore-lugs 10 and 11 during assembly of formwork equipment seen in the two previous figures. By analogy with the Mauser rifle-action, the fore-lugs have been inserted through the "gate" into the lipped cavity 8 or receiver and further anticlockwise rotation of body part 6 of this particular embodiment of the support bracket will cause the fore-lugs to house in said cavity and edge form lips 4 to house in lip housing slots 7 of support bracket.

Figure 4:
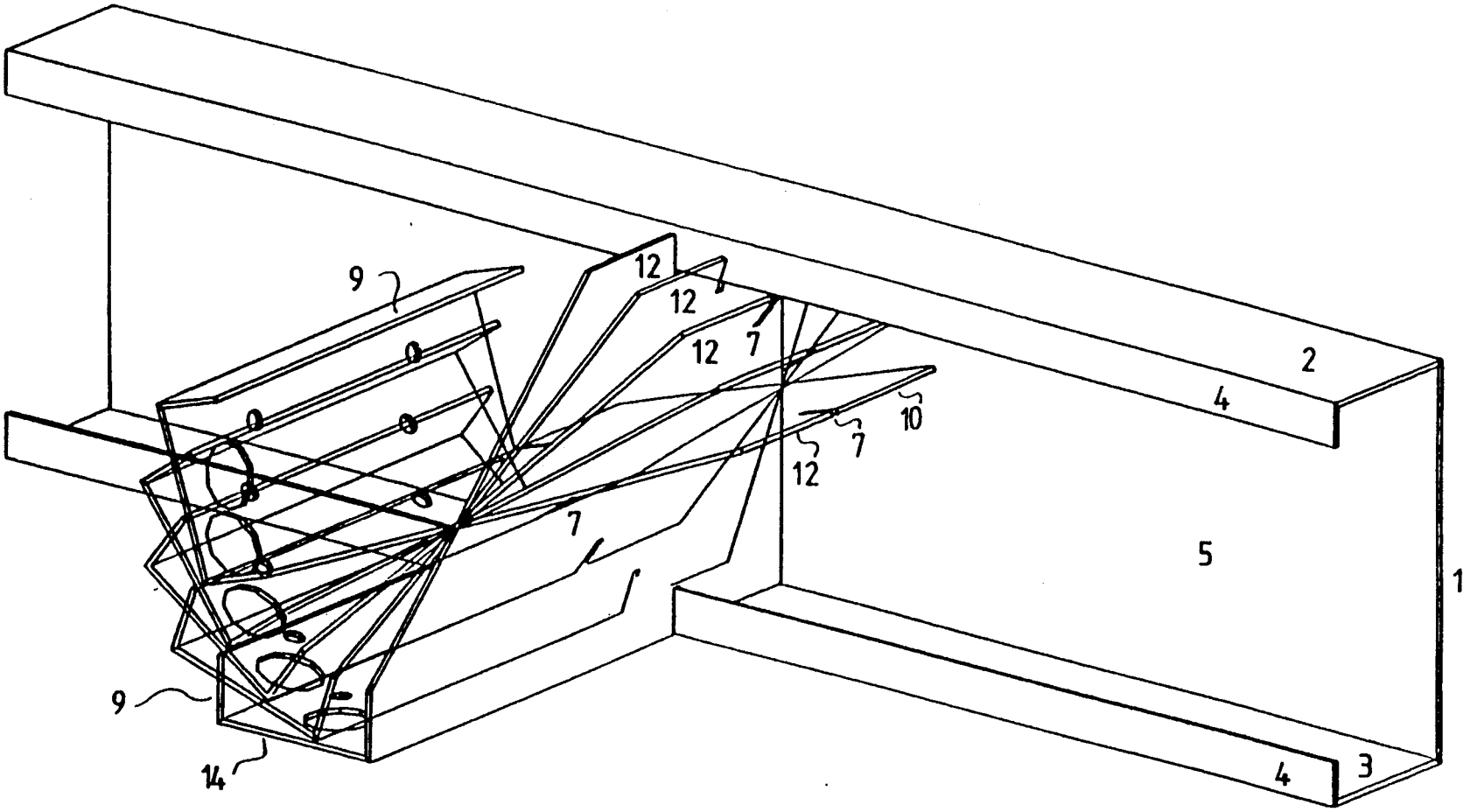
FIG. 4 shows overlaid pictorial views of the rotating-actioned engagement of equipment seen in FIG. 1 depicting rotation of form support bracket about an axis orthogonal to planes of centrelines of lips whilst the centreline of each lip housing slot is in the same plane as the centreline of its relevant lip.

FIG. 4 shows a computer-generated depiction of the Mauser-type engagement (rotation of fore-lugs about an axis orthogonal to plane of centreline of lips 4) between support bracket and edge form using parameters obtained from embodiments seen in the previous figures. This representation shows rotation about a more or less centred axis although other non-centred axes may be used. From the side elevation of the support bracket and transverse section of the edge form shown in operative connection in FIG. 2, it may be seen that in this embodiment, working clearance between fore-end or fore-part 25 of support bracket and rear of mould face 5 is small, whereupon during assembly, the action of inclining the support bracket gussetted body 6 from the vertical, followed by insertion of fore lugs 10 and 11 into the lipped cavity 8 until fore-end or fore-part 25 of support bracket butts against rear of mould face 5, followed by appropriate rotation as shown in FIG. 4 (anticlockwise for this embodiment) automatically places the appropriate parts of support bracket (centreline 20-20 of lip housing slots 7) more or less in alignment with, and plane of appropriate parts of edge form (centreline 21-21 of edge form lips 4) thereby increasing accuracy of alignment and speed of assembly. Disassembly of the described edge form to support bracket connection during stripping of formwork is achieved by the reverse rotation, thereby allowing edge forms to stay protectively in place against curing concrete, if so required.

Figure 5:
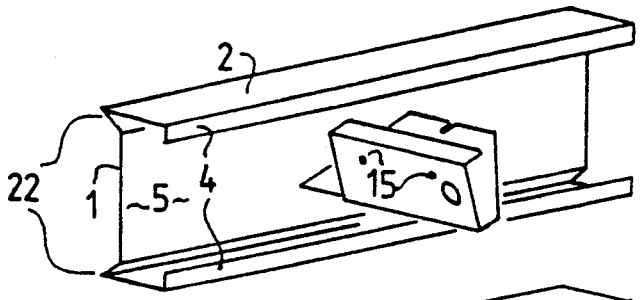
FIGS. 5, 6, 7, 8 and 9 show sequential pictorial views of assembly of a self-plumbing edge form support bracket with a self-chamfering "tilt-up" edge form wherein centreline of lip-housing slots of said bracket are orthogonal to its base plate and mould face of said edge form is suitably profile whereby chamfered edge profile will be produced in concrete cast against said self chamfering mould face.
Figure 6:
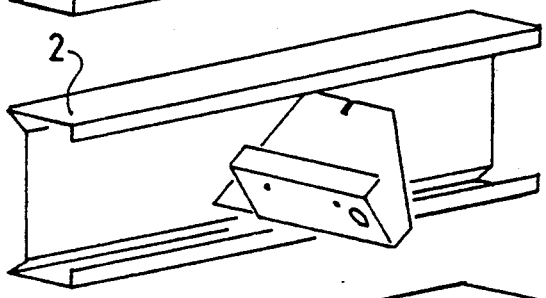
Figure 7:
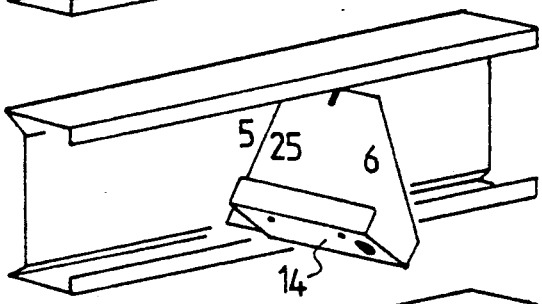
Figure 8:
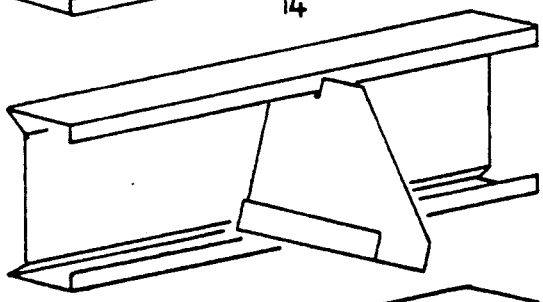
Figure 9:
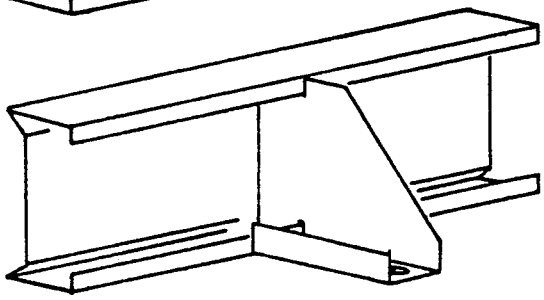

FIG. 5 through FIG. 9 depict separately from a different viewpoint, each stage of the rotation sequence described hereinbefore, the main parameters being the same with the exception that a self chamfering mould face is seen on the edge form via chamfer ribs 22. FIG. 5 demonstrates inclination of support bracket from the vertical and insertion of fore-end and fore-lugs into the lipped cavity. Anticlockwise rotation of support bracket between FIGS. 5 and 7 "squares up" the fore-end against the rear of the mould face causing lip housing slots to come into alignment with edge form lips thereby easing the housing of said lips seen in FIG. 8, whilst continuation of said bracket rotation leads to the essentially vertical bracket operatively connected with, and supporting the edge form, as seen in FIG. 9.

Figure 10:
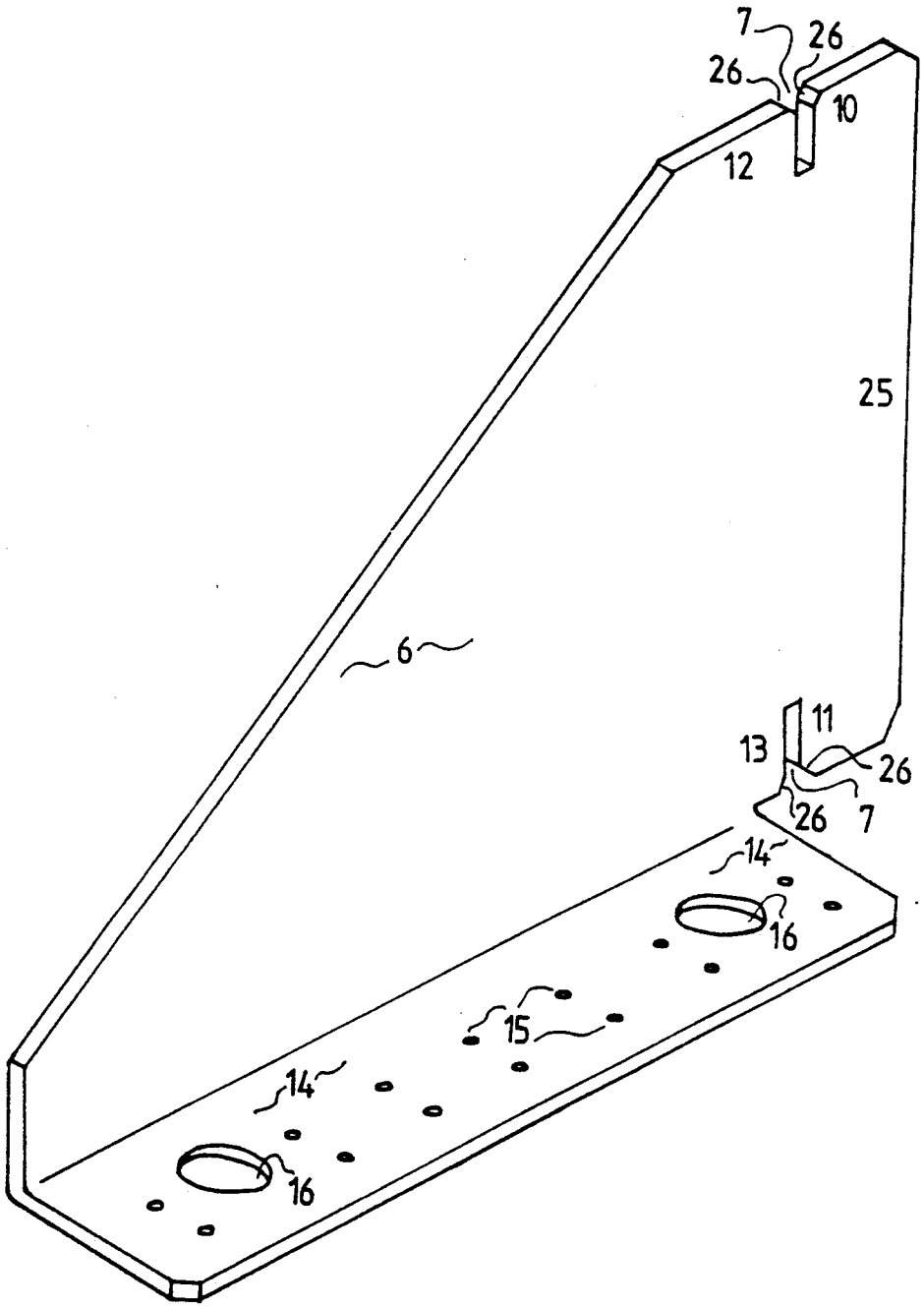
FIG. 10 shows a pictorial view of a self-plumbing "tilt-up" edge form support bracket as it might appear when constructed of aluminum plate.

Feed ramps (by analogy with the rifle mechanics) may be provided at the mouth of lip housing slots by removing or backing-off a small amount of material from fore and aft lip retaining lugs 10, 11, 12 and 13 at said mouth of lip housing slots as shown in the support bracket embodiment (constructed of 6 mm wall thickness aluminium plate) seen in FIG. 10. Said feed ramps open up the mouth of lip housing slots and act as guides facilitating entry of edge form lips into lips housing slots, thereby increasing speed of the described formwork assembly especially where fore end or fore part 25 of support bracket does not contact rear of mould face 5 when edge form and support bracket are operatively connected.

Figure 11:
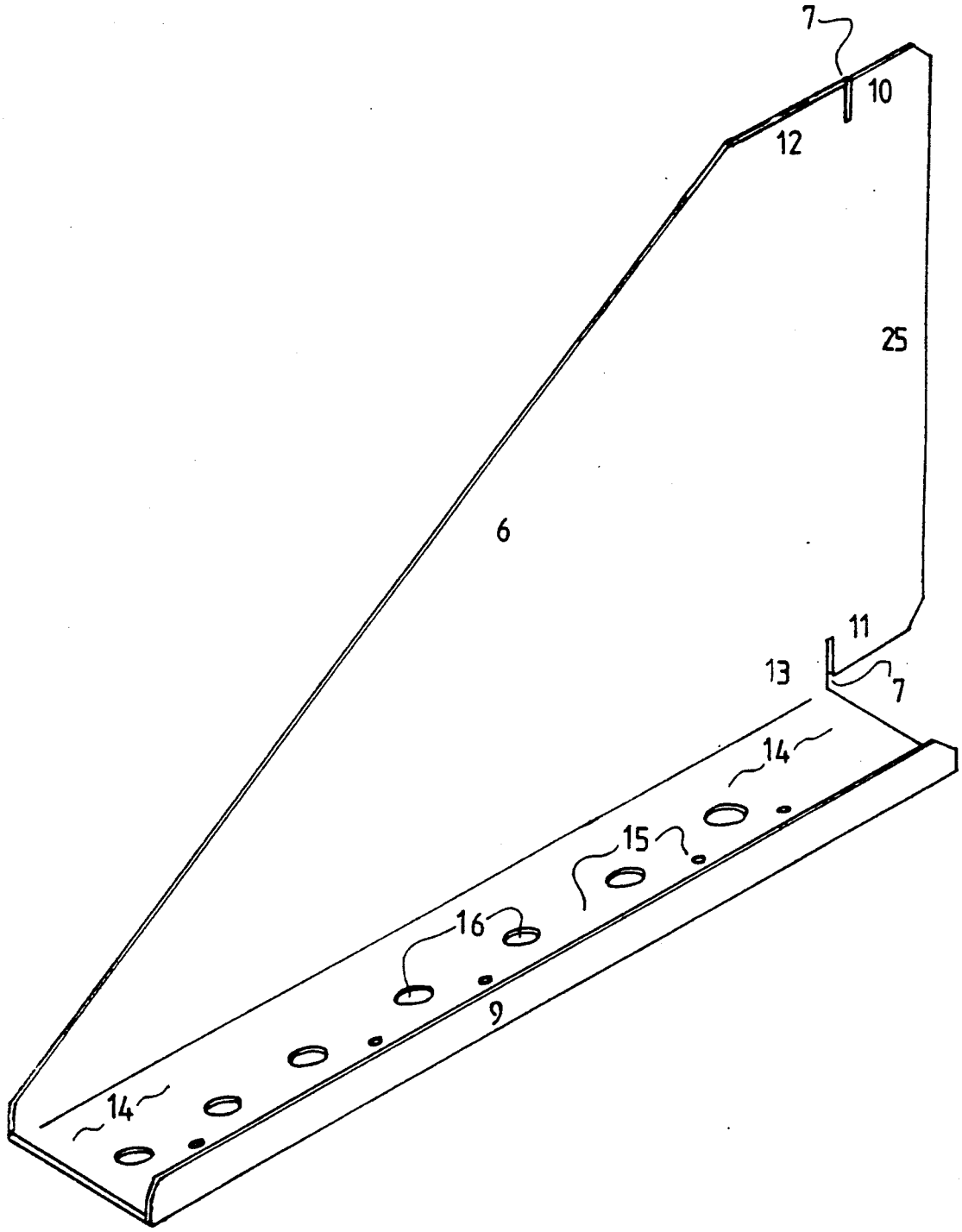
FIG. 11 shows a pictorial view of a self-plumbing edge-form support bracket as it might appear when cut from steel lipped chanel or roofing purlin waste.

FIG. 11 depicts an embodiment of the support bracket manufactured by cutting said bracket (back-to-back) from roof purlin (high tensile steel, 2.5 mm wall thickness) waste. This method of manufacture has proven effective for low volume production runs as the purlin web provides the fore-end 25, lip retaining lugs 10, 11, 12 and 13 and gussetted body part 6, whilst the purlin flange provides base plate flange 14 and purlin lip provides base plate flange stiffening lip 9 without requirement for metal folding equipment, welding or retempering.

Figure 12:
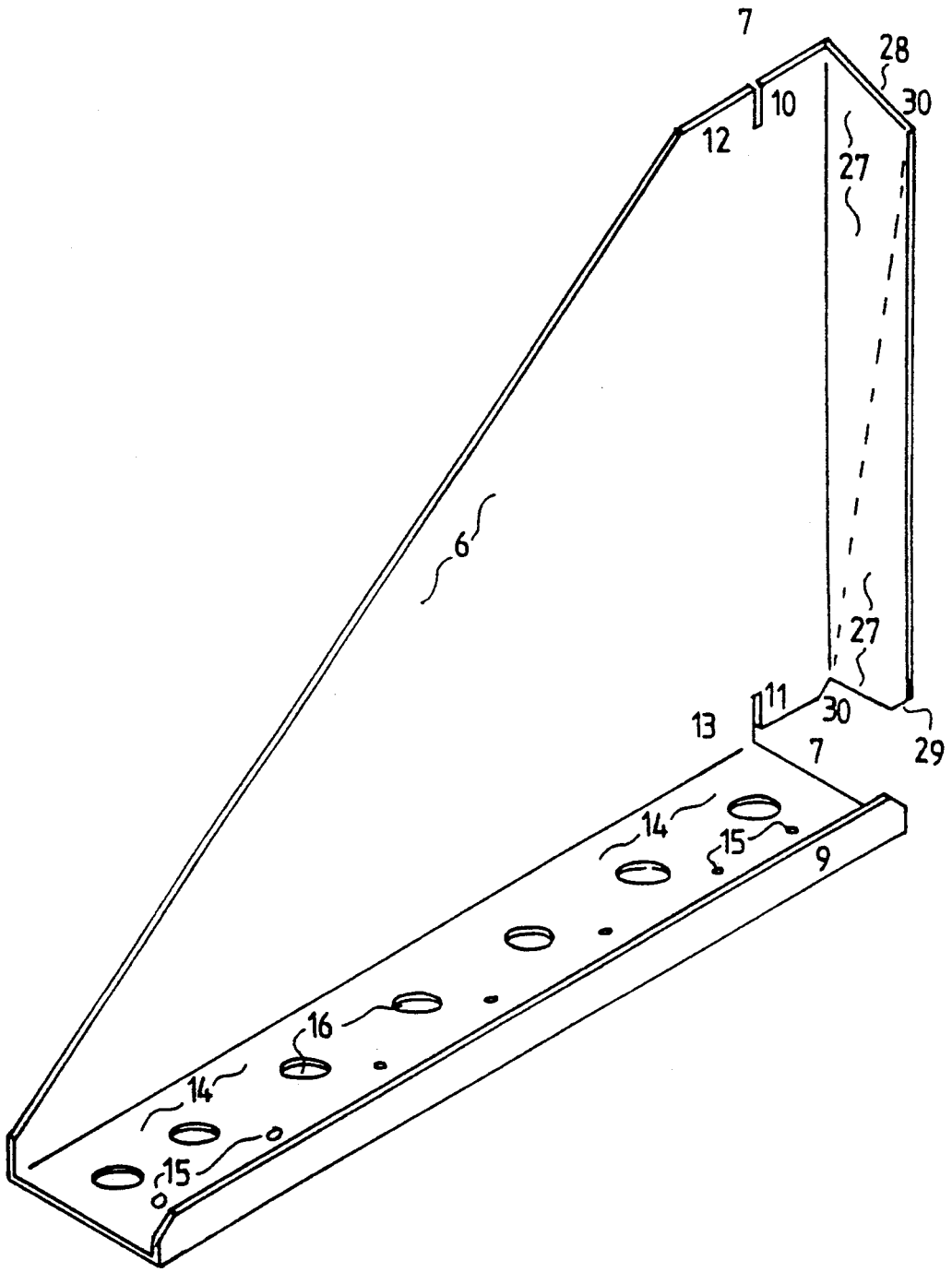
FIG. 12 shows a pictorial view of a self-plumbing edge form support bracket incorporating an alignment flange at the fore-end.

An alignment bracket is depicted in FIG. 12 wherein an extension of sheet metal of fore-end 25 is folded more or less at ninety degrees to form an alignment flange 27, the latter having material removed or backed off from its free edges at top 28 and bottom 29 to provide clearance in order that dimension of broken diagonal line 30—30 is less than internal dimension between flanges of edge forms. Need for said clearance to be provided is depicted in operation of an alignment bracket in FIG. 14 below.

Figure 13:
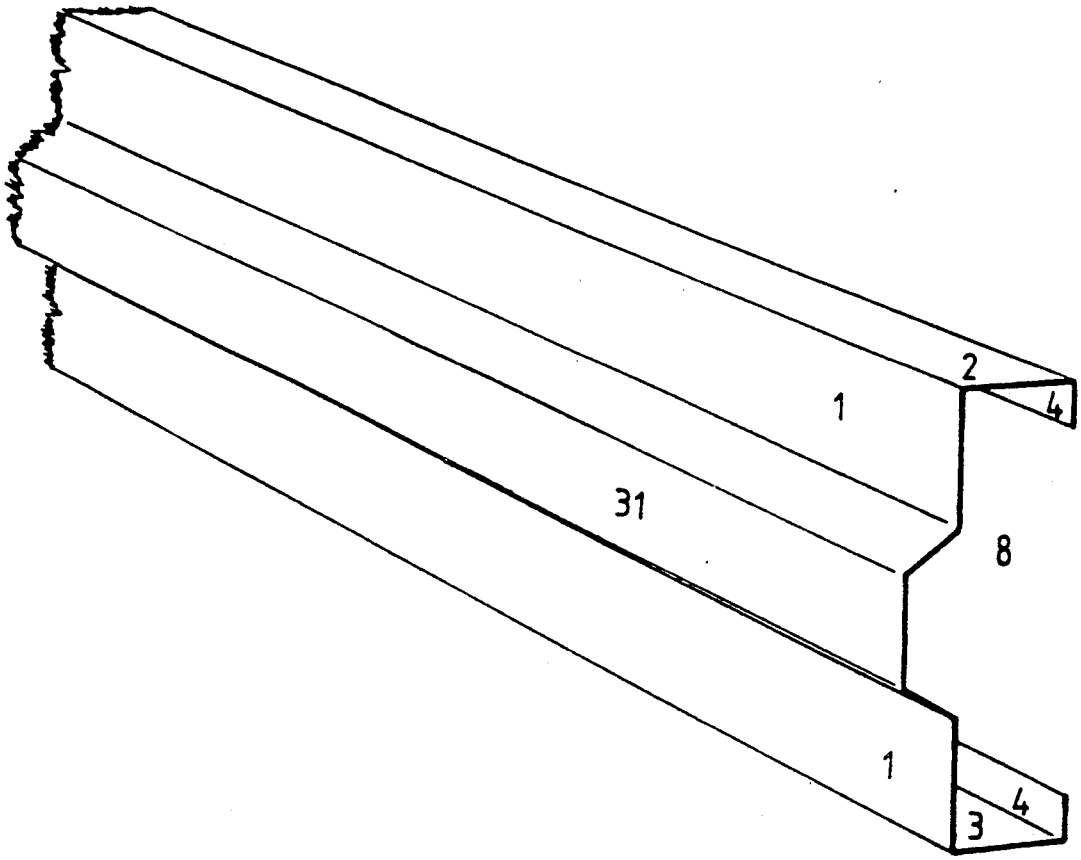
FIG. 13 shows a pictorial view of a lipped channel edge form with a mould-face suitably profile to produce the female side of a shear-key profile in cast concrete.

FIG. 13 depicts a lipped channel edge form wherein the major plane of mould face 1 lies rearward of an integral free-stripping key-forming protrusion 31 pressed (or otherwise formed during manufacture) in the sheet material of said mould face 1. Re-useable edge forms of this type are used for moulding the female side of shear key profiles into concreted slabs cast against mould face 1 and protrusion 31. Obverse concrete profiles are obtained by casting concrete against the lipped channel profile depicted in FIG. 16 and seen in transverse section suitable for support bracket engagement in FIG. 17.

Figure 14:
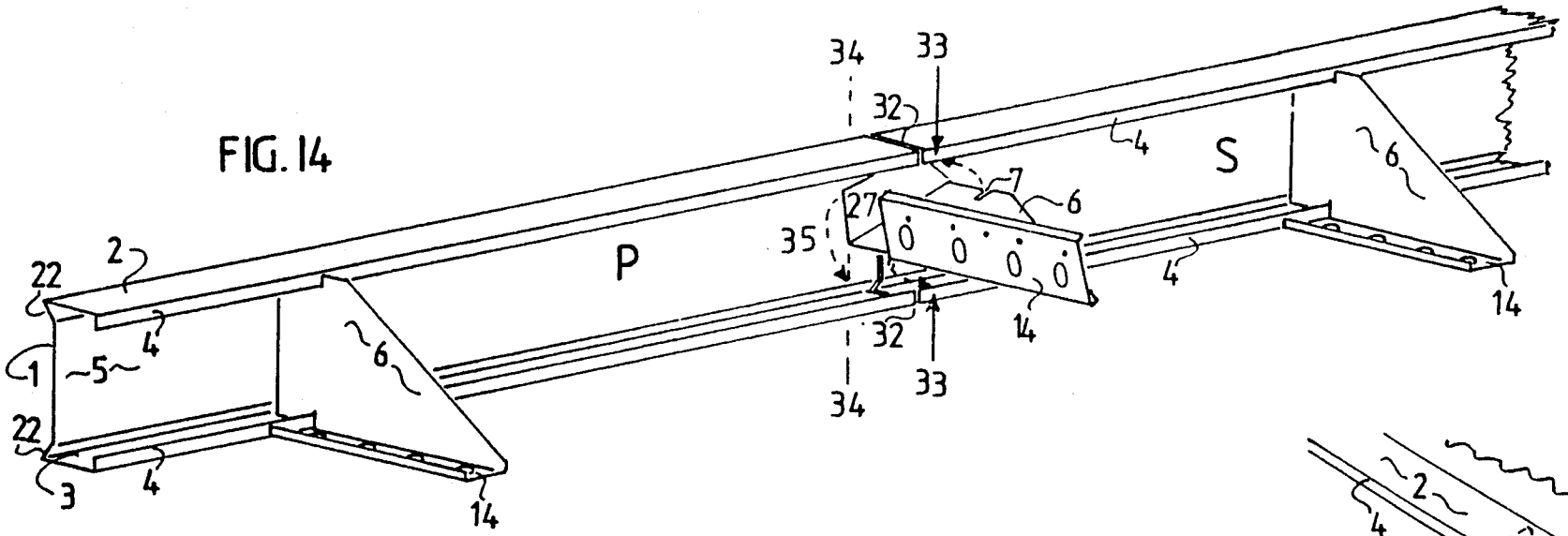
FIG. 14 shows a pictorial view of a method of assembly of edge formwork for casting of tilt-up panels depicting mould faces of adjoining lipped channel forms—end butted on a continuous line—being supported and aligned by an alignment bracket.

FIG. 14 depicts a method of assembly of "tilt-up" edge formwork wherein a join in two self-chamfering edge forms being end-butted on a continuous line is required to be supported and aligned. Support brackets of the type shown in FIGS. 1 through 9 are operatively connected to left (port) and right (starboard) of the join in the edge forms. Said brackets when viewed in elevation from their rear (rear elevation) have a more or less reversed 'L' shape with gussetted body part 6 represented by the vertical bar of said 'L' and base plate flange 14 the horizontal bar. It matters little for most applications whether base plate flange 14 is disposed to port or starboard in said elevation, except for nesting characteristics and direction of rotational engagement. In said elevation, brackets with base plate 14 disposed to starboard, as in FIGS. 10, 11, 12, 20 and 21, engage edge forms via clockwise rotation of bracket without disturbing positioning of edge form. Brackets with base plate flange 14 disposed to port as in FIGS. 1 through 9 and in FIG. 14 are operatively connected to non-pour side of edge form via anticlockwise rotation without disturbing edge form postion. There are definite advantges is being able to assemble/disassemble said brackets from edge form whilst edge form is in position against curing concrete and since disposition of base plate flange affects optimum direction of rotation it may be seen that there are advantages in having both port and starboard base plated brackets, as in certain situations one or the other type of rotation may be denied. A futher consideration is direction of projection of alignment flange on alignment flanged brackets as depicted in FIG. 12 and centrally in FIG. 14. When viewed in the described rear elevation the former figure depicts both base plate 14 and alignment 27 flanges to starboard, whilst the latter has both base plate and alignment flanges to port. If these are called respectively starboard/starboard and port/port configurations, it will be understood that during the rotational engagement of an alignment bracket with non pour side of edge form the top free edge of the alignment flange will foul the inside of the top flange 2 of the edge form unless the former is relieved by removal of material 28 as depicted in FIG. 12. By way of example, if an alignment flange was 150 mm high (6 inches) and 75 mm wide (3 inches) the unrelieved diagonal dimension according to direction of (relieved) broken line 30—30 in FIG. 12 would be 167.7 mm (approximately six and three quarter inches). Therefore approximately 20 mm of the top free edge of the alignment flange must be removed during manufacture (as shown in FIG. 12) because in a port/port or starboard/starboard configuration of base plate and alignment flanges the top free edge of alignment flange is a leading edge and bottom free edge is a following edge during action of rotational engagement with "in place" edge forms and the leading edge fouls the top flange of the edge form. The reverse is true of a port/-starboard or starboard/port configuration of base plate flange/alignment flange. In these two cases where said flanges are made opposing, described rotational engagement of alignment bracket with edge form results in the bottom free edge of alignment flange fouling the bottom edge form flange because bottom free edge of alignment flange is, in these latter two cases, the leading edge.

Alignment flange has other uses such as temporarily blocking holes in mould face and where self chamfering mould faces A and B are required to meet at a corner normally requiring scribing of chamfer ribs 22 against each other, the appropriate starboard/port or port/starboard configuration of alignment bracket flanges will allow a suitably relieved alignment flange (see 29 in FIG. 12) to project past end of edge form to which it is operatively connected (A) and butt up to mould face 1 of the side edge form (B) without fouling chamber ribs 22 of the latter. In accurate work, appropriately scribed end or make-up pieces may be either nested behind A or slipped over the projecting alignment flange; alternatively in common work, any small discrepancy may be made-up by caulking.

For purposes of clarity in the drawings, base plate and alignment flanges are turned together (non-opposed) either port/port as in FIGS. 1 to 9 and 14, or starboard/starboard as in FIG. 12. From the discussion above there is little lost and something (elimination of need for scribing the corners of chamfer ribbed 22 formwork) to be gained by having base plate and alignment flanges opposed to each other as in the port/starboard and starboard/port configurations respectively. From the important on-site handling consideration of stacking or nesting of alignment brackets, the opposed configurations (P/S and S/P) are just as good as the non-opposed (P/P and S/S) and since the operator of this equipment has two hands, he may carry a half-dozen nested port/starboard brackets in one hand and a half-dozen nested starboard/port brackets in the other. Therefore, the preferred tilt-up arrangement of said alignment brackets is base plate opposed to alignment flange, the former to port, latter to starboard, in roughly equal numbers with its converse, especially when using self chamfering edge forms.

In general, a certain amount of cutting of edge forms may be eliminated by using a "follow-on" method in right-angled corners wherein one of the edge forms (C) is butted orthongular to the other edge form (D), the latter being allowed to "fly-by" without being cut where this is possible. An opposed alignment bracket is used as described, if forms are self-chamfering, and thereby said corner becomes the start point for edge form (C) which at its other end is allowed to "fly-by" the next corner. Further, since very thin sheet metal may be used in tilt-up casting by use of this invention, operators' hands may be easily protected by folding or laminating the free edge of the lip material back on itself, thereby reducing the need for gloves when handling very thin sheet metal edge forms. Obviously, synthetic forms or plastic-coated forms will have the same result, but are more expensive.

Concerning now, rotational engagement action of the alignment bracket of port/port configuration found centrally in FIG. 14. Said bracket will provide support, via its portside alignment flange, to self chamfering edge forms to port (P) and starboard (S) of join 32. When operatively connected (with gussetted body part 6 of said bracket in vertical position, after anticlockwise rotation) top and bottom lip housing slots 7 of said bracket will house lips 4 of starboard edge form at position of the arrow heads of solid vertical lines 33—33. Curved broken lines leading from top and bottom lip housing slots 7 shows rotational path of latter to vertical support position on lips 4 denoted by heads of arrows 33—33. Port-side alignment flange 27 of said alignment bracket supports rear of mould faces 5 of both starboard (S) and port (P) edge forms as far as dotted vertical line 34—34 on rear of portside mould face. Curved broken line 35 indicates approximate path of (relieved) bottom face corner of alignment flange to its support position on broken line 34—34.

Figure 15:
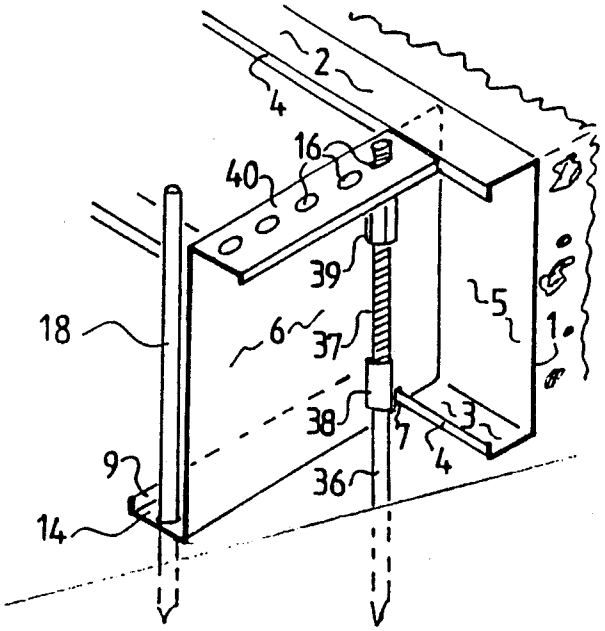
FIG. 15 shows a pictorial view of a method of height adjustment of lipped channel edge forms wherein the support bracket is equipped with a top mounted flange opposed to the base plate flange.

FIG. 15 depicts a method of cantilevering lipped channel edge forms longitudinally above a parallel footing trench. Support bracket has a gussetted body part 6, lip housing slots 7, and is operatively connected to edge form via rotational engagement (as described above) and, in addition to base plate flange 14, has an opposed, top-mounted, holed flange 40 which may be acted on by a lifting means enabling edge form to be brought to requisite height. Base plate flange 14 is holed as described above and appropriate anchor means to earthen subgrade (e.g. a three-quarter inch diameter steel rod 18) is driven through suitably clearanced holes in base plate. Ground spike 36, similar to 18, is driven into subgrade until it is firm and acts as a pile. Threaded rod 37 has weleded at its lower end a hollow plug 38 which fits over the head of ground spike 36. Height adjustment nut and washer 39 is turned up the threaded rod 37 which fits through hole 16 in top flange 40 thereby raising front of support bracket and its supported edge form to the specified height and level.

FIG. 16 shows an isometric view of a re-usable, female mould-faced, lipped channel edge form, the major mould face plane thereof being forward of a free-stripping longitudinal depression 41 located centrally in said mould face whereby the profile of the male side of a shear-key joint is produced in the edge of a concrete slab cast against said mould face. Said edge form is therefore complementary with the embodiment shown in FIG. 13.

FIG. 17 shows a transverse section of said female mouls faced lipped channel edge form at a point suitable for operative connection with a support bracket of the type described herein. Where it is necessary for dowel bars or like reinforcement (located centrally in the slab being cast) to penetrate edge forms of the type shown herein, the preferred method is to punch (or hole-saw cut, as the form is quite thin) holes with suitable clearance, similar to that used for timber edge forms, and before case concrete has hardened, to run a soft, very wet broom along rear of mould face 5, thereby diluting, weakening and partially removing any concrete leakage around dowel holes. Because it is not necessary for mould face wall thickness to be much greater than one millimetre, virtually all of said concrete leakage is easily accessible to action of said broom plus water, and the problem common to thick walled edge forms (hardened concrete packed between dowel and internal surface of hole) is eliminated due to the negligible wall thickness and thereby stripping of edge forms from cured concrete and dowels is facilitated, leaving edge forms undamaged.

In FIG. 18 a lipped channel edge form used for stack-casting of tilt-up type concrete wall panels has single-faced, chamfer-producing ribs 22 and said ribs double-faced 42 formed as protrusions from major mould face plane 1. In this particular embodiment suited for stack-casting two thicknesses of concrete slab sequentially, the central chamfer-producing rib 42 acts as a divider between slats to be cast and lends its lower face to produce upper chamfer on lower slab 43 and upper face to produce lower chamfer on upper slab.

In FIG. 19 the method and height of casting of lower concrete slab 43 is shown in a transverse section at a point suitable for operative connection with a support bracket of the type described herein. Clearly edge forms of this type can be manufactured to suit stack casting a depth of three, four, or more sequential tilt-up slabs. In these cases however, it is preferable to provide reinforcement (via gussetting, or the like) at, for example, metre centres to lipped cavity 8 thereby providing both support to rear of mould face and maintenance of dimension between lips 4. (Said reinforcement does not affect operation of support brackets described herein). Wall thickness of such edge forms can be quite small because consideration of live load of fluid concrete to be reacted or retained is due to depth (or thickness) of only one slab being cast at a time—further, dead load of first slap 43 is virtually zero when live load of second slap (due to placement of fluid concrete) begins to act against mould face 1.

Operatively connected edge form support brackets have been hereinbefore described with fixed single angle relationship between centreline of lip housing slots and base plate capable of automatically plumbing mould face of (equal flanged) lipped channel edge forms when base plate of said bracket is mounted on, or anchored to, a flat and level casting floor or reference plane whilst lips of said edge form are housed in lip housing slots of said bracket, because centreline of said slots has hitherto been orthogonal to the base plate 14 of said bracket.

Figure 20:
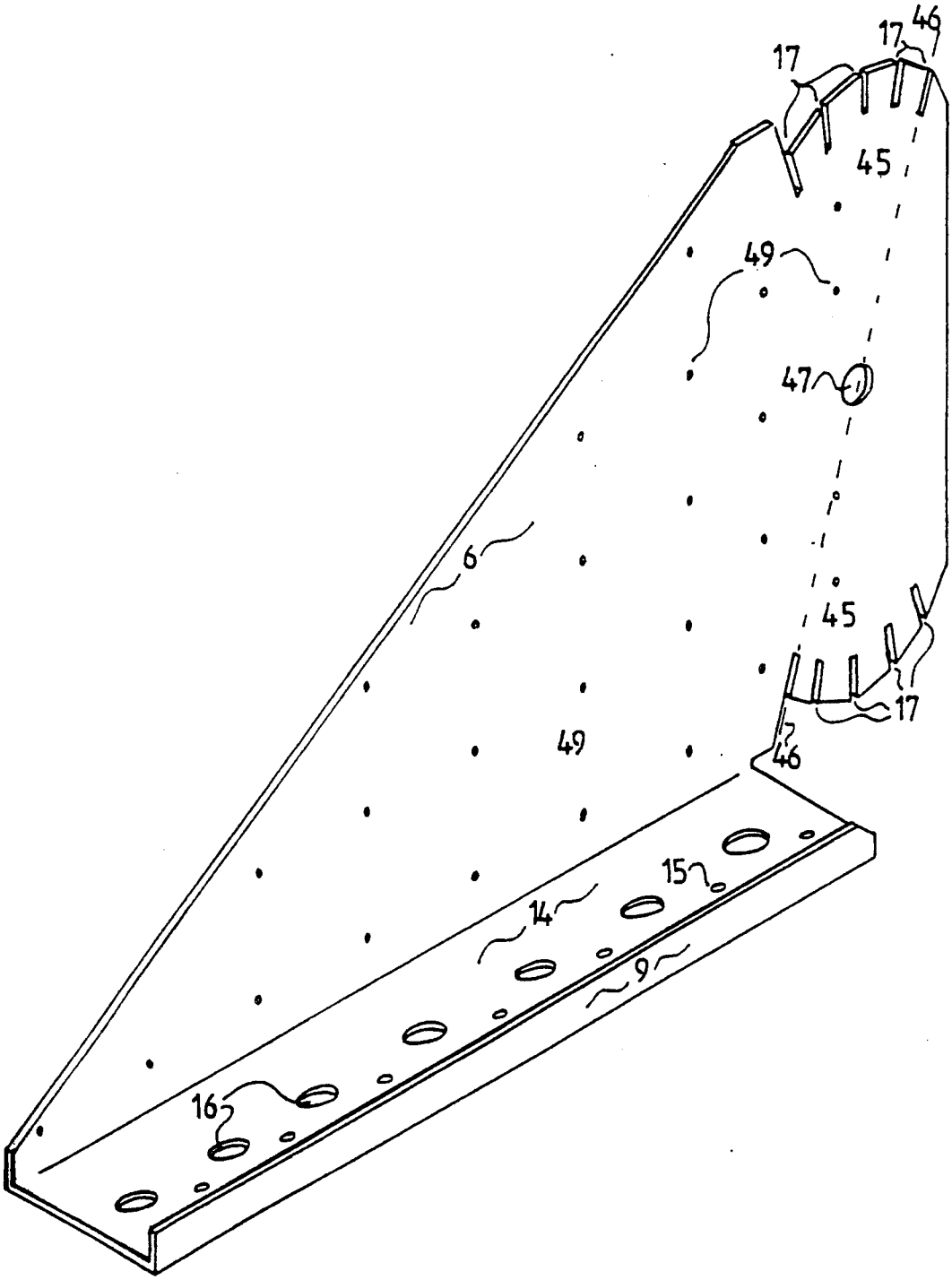
FIG. 20 shows a pictorial view of an edge form support bracket whose forward mounted edge form attachment means comprises multiple pairs of radially opposed lip-housing slots.
Figure 21:
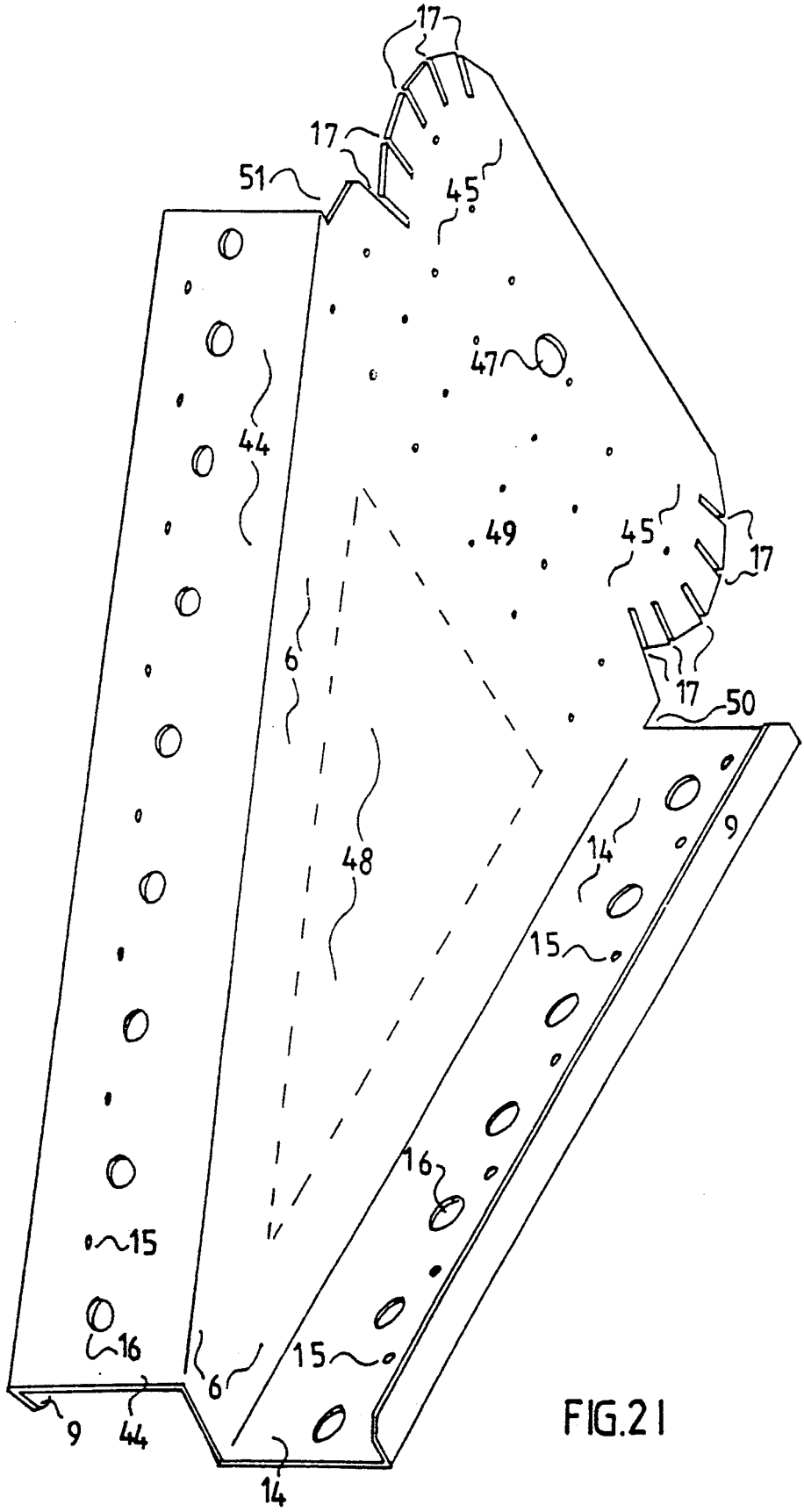
FIG. 21 shows a pictorial view of an edge form support bracket combining the features of multiple pairs of radially opposed lip-housing slots (seen in FIG. 20) and the top-mounted flange of FIG. 15.

FIGS. 20 and 21 show embodiments of the support bracket wherein the fore-end 45 thereof, or edge form attachment means, includes a plurality of radially opposed lip housing slots 17 at top and at bottom thereby allowing variation in angle between mould face and base plate flange whereupon consideration of transverse sections of operatively connected edge form and support bracket admits of a number of non-orthongular relationships and applications in edge formwork construction. These include, firstly, support bracket base plate 14 seated along its full length on a flat and level casting floor (as in the tilt-up case of mitred corner panels) with operative lip housing slots selected to give an out-of-plumb mould face; secondly, said base plate 14 seated on non-level casting floor or subgrade with said operative slots selected to give a plumb mould face; and thirdly, the case of irregular subgrade and/or generally where an edge form must be raised above the level of casting floor subgrade or trench (see FIG. 15) in order to bring top of edge form more or less level with specified top of fluid concrete, wherein by suitable selection of operative lip housing slots is obtained a plumb mould face elevated and supported by inclination of support bracket and base plate thereof, whereby rear portion of latter abuts subgrade whereto said portion is anchored by suitable anchoring means.

As the first case is fairly straightforward, the nature of the second and third cases described above is illustrated in FIGS. 22 and 23 by transverse sections of lipped channel edge form operatively connected with an invertible support bracket of the type seen in FIG. 21, the latter combining the feature of plurality of radially opposed lip housing slots 17—seen in the curvilinear fore-end 45 of the FIG. 20 embodiment—with an inclined, top-mounted flanged 44 opposed to, and non-parallel with base plate flange 14. Function of said inclined top-mounted flange 44 includes that of flange 40 seen in the FIG. 15 embodiment and, in addition, upon inversion of the FIG. 21 embodiment, said inclined flange 44 acts as base plate flange thereby changing the attitude of fore-end 45 and radially opposed lip housing slots 17 in relation to subgrade, whereupon range of adjustment of angle between base plate and major mould face plane 1 is increased. Further, since part of said range of adjustment provided by base plate flange 14 overlaps said range provided by flange 44 acting as base plate, a vernier effect may be obtained, thereby increasing the fineness of adjustment. A limitation on said fineness is imposed by character of sheet metal from which the support bracket is constructed. Said radially opposed lip housing slots may be formed close together in a sheet-metal support bracket if fore-end 45 is strengthened by, for example, lamination of 45 folding an extension of the latter back upon itself and joining the layers thus formed during the manufacturing process, resulting in thicker and stronger lip retaining lug material allowing increase in number of slots 17 by closing up slot centres.

For various purposes, it may be advantageous to remove extraneous material more or less bounded by broken line of triangle 48 leading to a shape of the finished support bracket resembling the product of a method of welded construction whereby metal angle is used to form at least base plate flange 14 and inclined opposed flange 44. Said latter method of welded construction has certain advantages in larger support brackets wherein thicker material may be used to form fore-end 45 and lip retaining lugs thereof, and removed extraneous material 48 has higher value. Said larger brackets find use in, for example, support of multiple stack-casing tilt-up edge forms, parapet construction, and corbelled edge forms for use in both precasting and cast-in-situ construction, the latter including monolithic casting of footing/retaining wall, ground slab and weather proofing elements simultaneously. In this context it may be noted that curved (truncated) edge formwork may be obtained fairly easily from the simpler lipped channel profiles by cutting top 2 and bottom 3 flanges at appropriate centres, whereupon the longitudinal stiffening effect of said flanges is reduced at each discontinuity, but bracket attachment function is retained. Further, plastic-coated lipped channel may be obtained by using sheet steel which is plastic or nylex-coated (technology for manufacture of the latter is well known) as start material in manufacture of lipped channel edge forms.

Nail holes 49 are shown in gussetted body part 6 and fore-end 45 of embodiments in FIGS. 20 and 21 enabling temporary attachment to timber falsework during formwork erection over, for example, caved in footing trenches in a method which may be used in conjunction with, or as an alternative to the method depicted in FIG. 15. Along the line of to-be-cantilevered forms wooden height support pegs are driven about every ten feet or three metres, said pegs being four to six inches behind the intended line of mould face. Coincident with peg position, support brackets of the type shown in FIG. 20 and/or 21 are operatively connected to edge forms, then said bracket attached to form assembly is lifted and fixed to said peg (by nails driven through nailing holes 49) when top of mould face is a little above the intended height of fluid concrete. Once intervening support brackets have been operatively connected to edge form by appropriate selection of lip housing slots 17 thereby allowing rear portion of either base plate 14 of 44 to about and be anchored to subgrade further wooden height support pegs may be attached to support brackets at suitable centres. Original height support pegs and bracket may be left or removed and with aid of optical or laser levelling equipment wooden height support pegs are driven further into subgrade until top of edge form is at correct height. It should be noted such wooden pegs are acting as piles supporting dead load of formwork, not reacting live load of fluid concrete placement as reaction of the latter is function of anchor means 18. Operative base plate hole 16 is stopped from rising up anchor means 18 by jamming or hold-down means.

Preferably, efficiency of such cantilevering is increased by jamming wall of operative base plate hole 16 against anchor means 18 via jamming means, hold down means or an anti-lift lock acting from anchor means 18 to base plate flange (details of the latter are disclosed separately in Australian Specification 22807/88 and U.S. Ser. Nos. 07/249380 and 07/249941). In order that height support pegs may clear base plate flanges 14 and 44 of the FIG. 21 embodiment base plate flanges are relieved or held back at 50 and 51 respectively. Broken line 46—46 represents the centreline of one pair of radially opposed lip housing slots 17 as shown in FIG. 20. Because there is a plurality of said lip housing slot pairs, a plurality of intersecting centrelines may be drawn and hole 47 in fore-end 45 (of the embodiments seen in FIGS. 20 and 21) is centred on said intersection thereby hole 47 bears constant relationship with lips 4 of operatively connected edge form when adjustment of angle between operative base plate flange 14 or 44 and mould face 1 is made by moving from matched pair to matched pair of radially opposed lip housing slots as seen in FIG. 23 where two pairs of slots are jumped each time to illustrate extremes of adjustment. FIG. 22 illustrates movement of position of centrehole 47 to position 52 when adjustment is made at one slot instead of at both of the opposed pair; the dimension of said movement is then more or less equal to half the dimension of lip housing slot centres. Such a relatively constant relationship between centre hole 47 and edge form lips 4 and thereby mould face 1 may be exploited by using centre hole 47 as basis anchor point for other apparatus; for example, location of cast-in hold down bolts at slab perimeter and penetrations, setdowns and the like in cast concrete.

Figure 24:
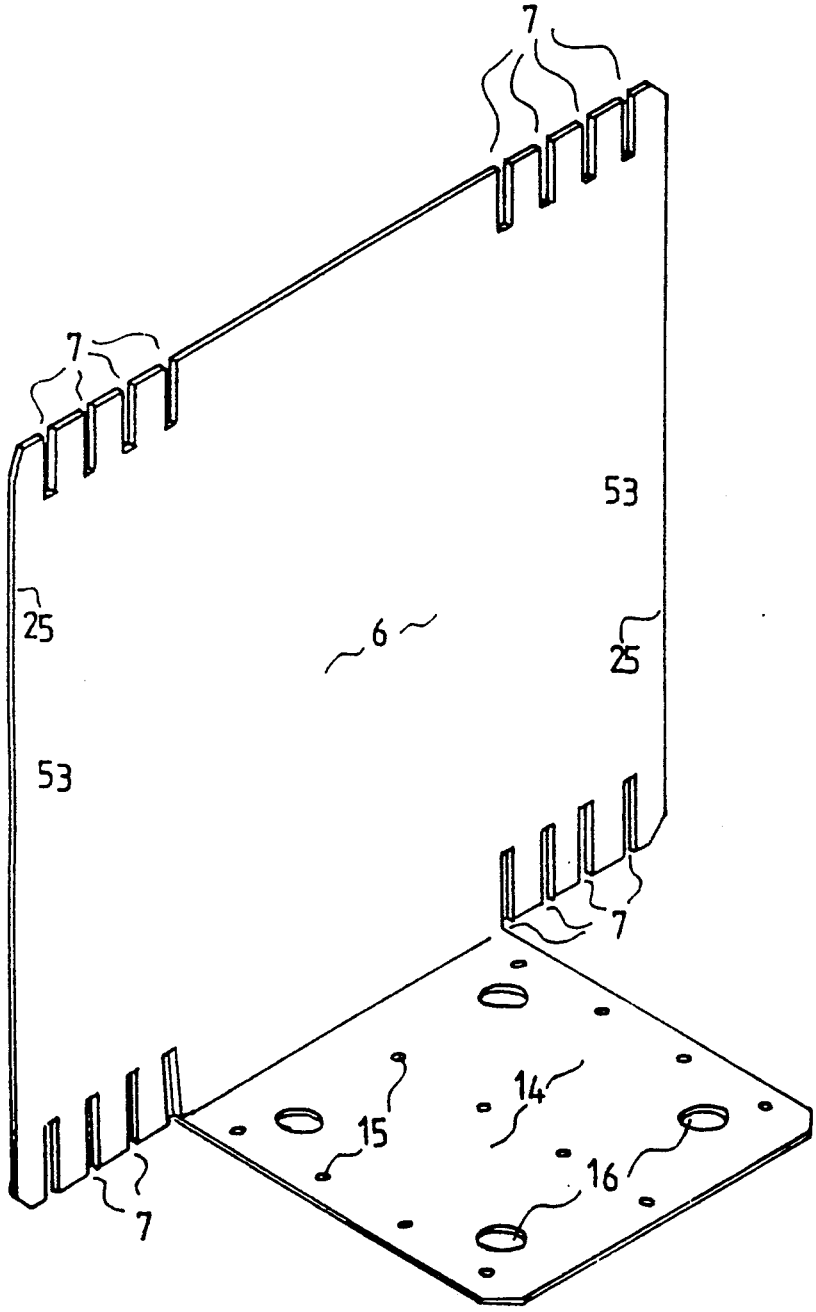

Range of adjustment between operative base plate flange 14 or 44 and mould face 1 are demonstrated in FIG. 22 wherein flange 14 is operative and FIG. 23 wherein flange 44 is operative. In practice on uneven subgrade, the stepwise nature of said adjustment has not been a problem and externally braced metal edge forms were set as accurately and at least as fast as is possible with timber edge forms. Ability to react live concrete loads is better and stripping is considerably faster than with comparable timber formwork.

Where a void must be formed between cast concrete as in walls of box drains, separation between tilt-up panels and the like, a support bracket of the type shown in FIG. 24 allows one form support to provide support to lipped channel edge forms on either side of said void. Rotational mode of engagement of said bracket with edge forms is as described, release is facilitated by cavity 8, gussetted body part 6 provides load transfer from either edge form to base plate 14 and thereby casting floor anchor means and selection among lip housing slots 7 allows for variation in width of said void. Where male/female type shear key profiled edge forms are routinely used (see FIGS. 13, 16 and 17) on either side of the void, selection of inner lip housing slots 7 may cause fore-end 25 to foul depression 41 of the edge form embodiment shown in FIGS. 16 and 17. Therefore in this case it is preferable to remove enough fore-end material in region of 53 to allow fore-end 25 to clear depression 41 and lip retaining lugs to clear edge form lips during bracket release.

Figure 26:
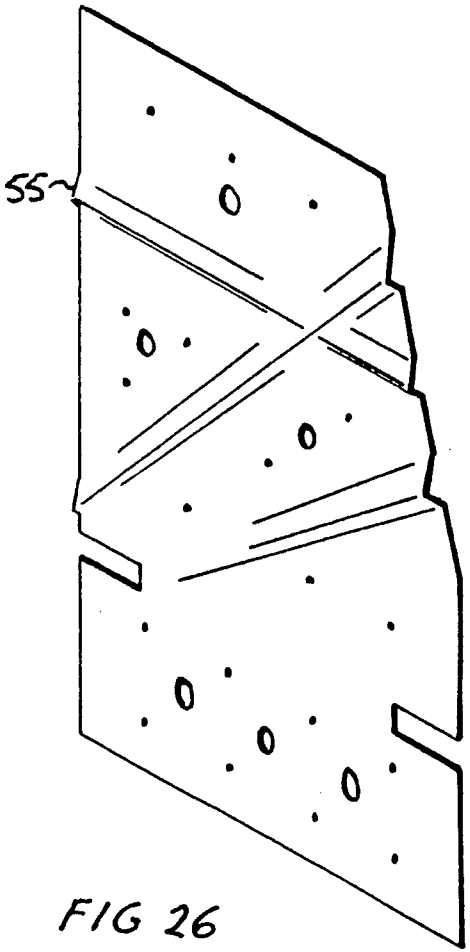
FIGS. 25 and 26 shows pictorially a method of reinforcing nailing type form support brackets to counteract side loads.
Figure 25:
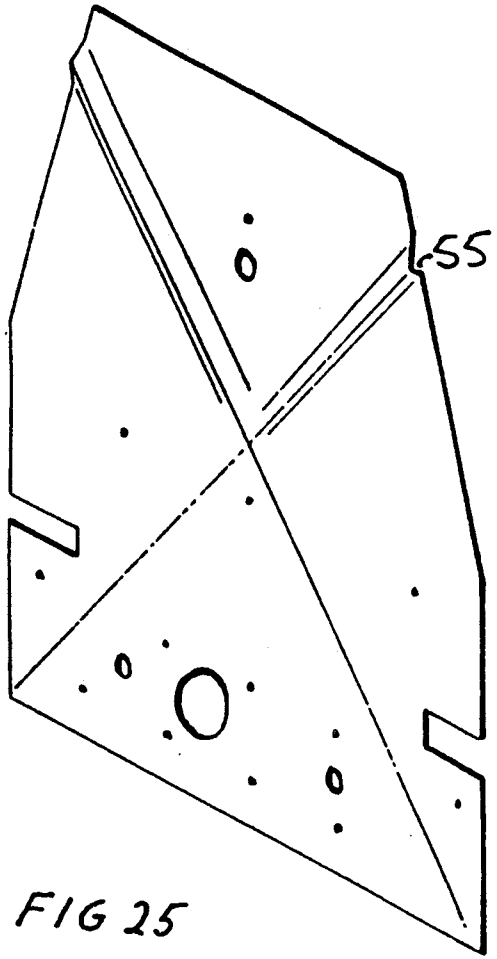
Figure 27:
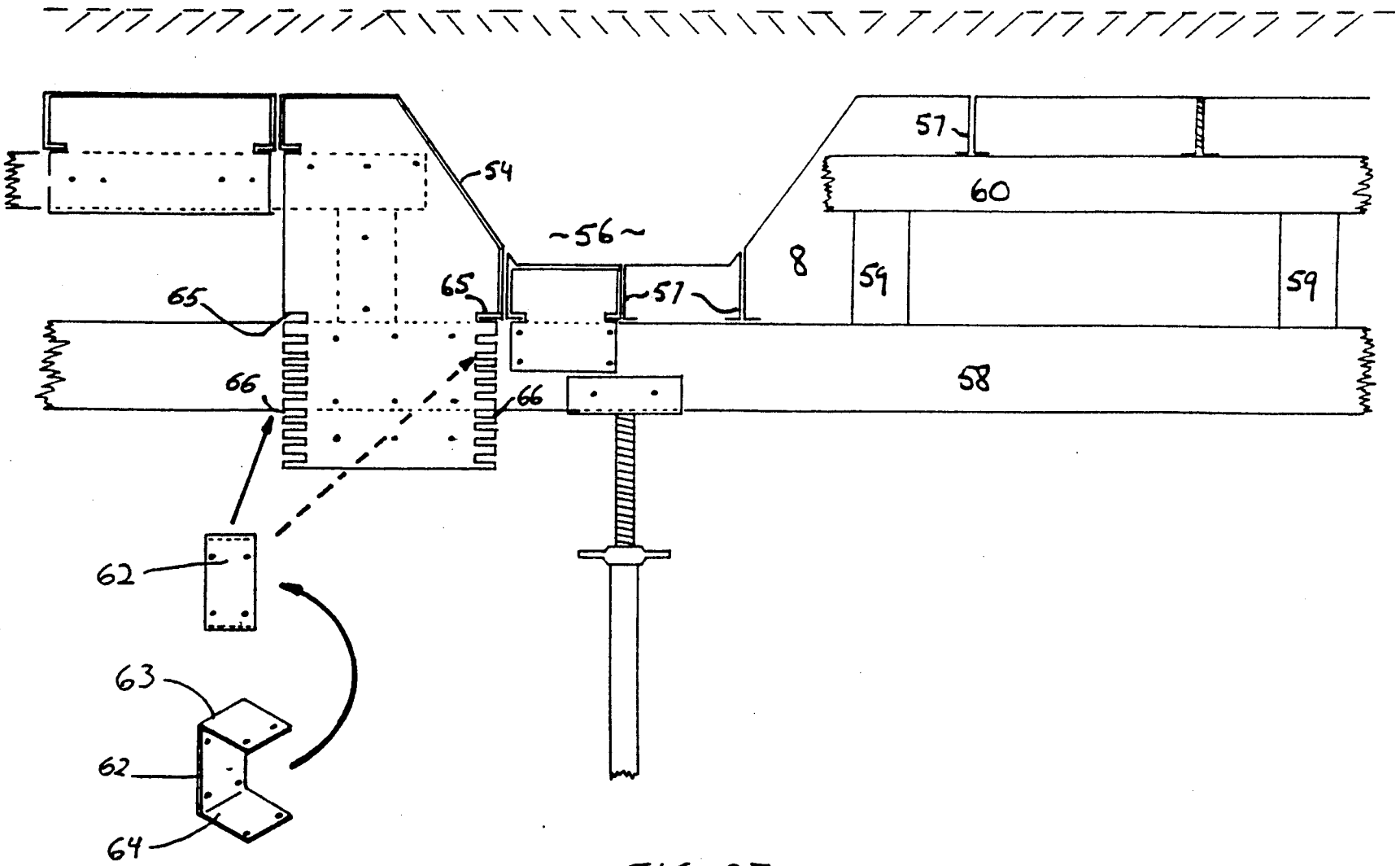
FIG. 27 shows a transverse section of modified lipped channel forms incorporated in suspended deck formwork.
Figure 28:
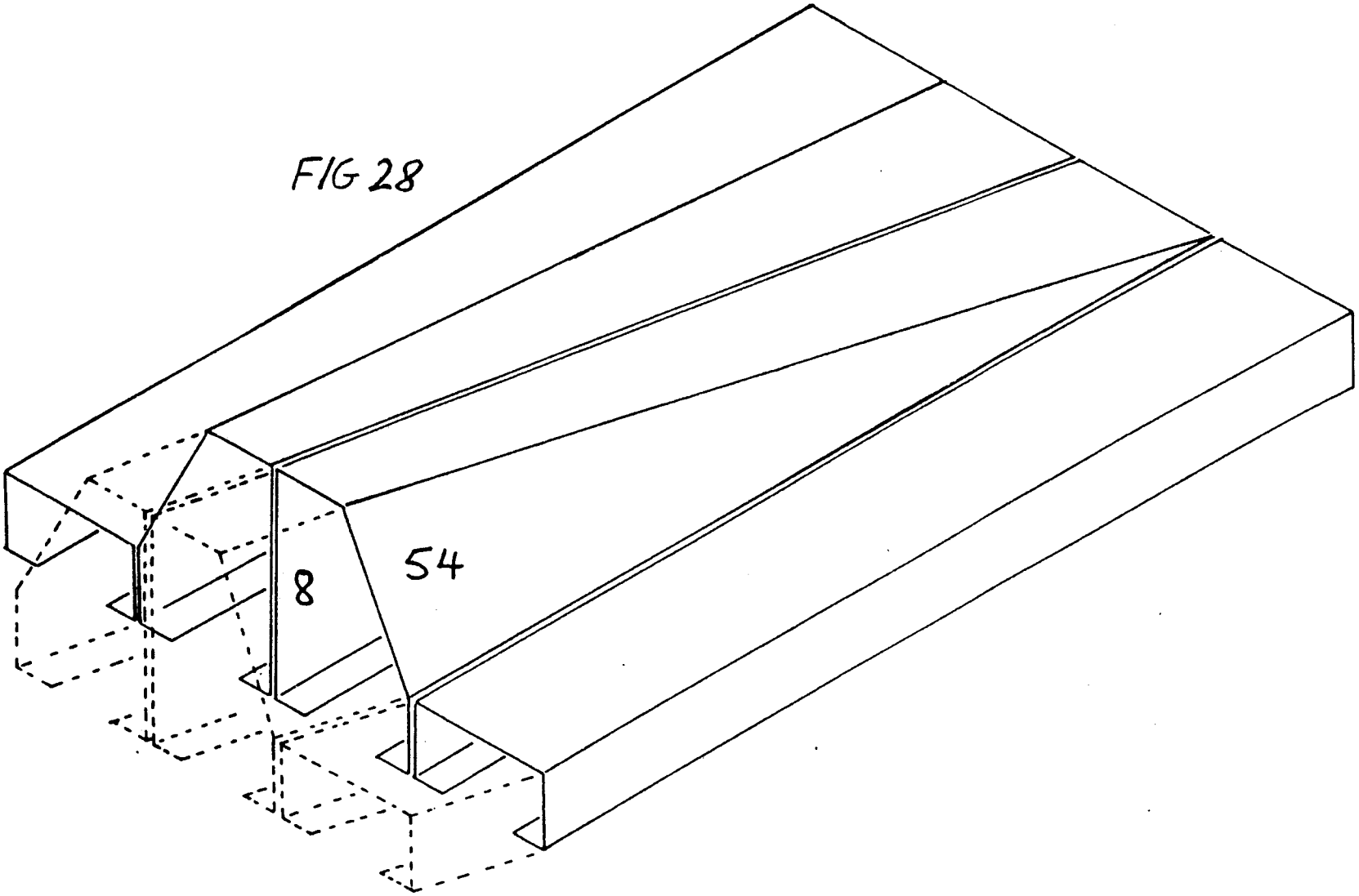
FIG. 28 shows pictorially, modified lipped channel forms arranged in a diminishing beam.

Mould face of modified lipped channels used as void formers or as beam sides 54 in suspended decks (seen in FIGS. 27 and 28), or precasting, require ribbed support to mould face at regular intervals by gussets to cavity 8 and by reinforced form supports seen in FIGS. 25 and 26, the latter being strengthened by crimp or indent 55 to resist lateral loads such as those arising from beam concrete 56 in FIG. 27 where vertical flanges of channels 57 acting as joints cross main bearers 58 and deck bearers 60, the latter supported from the former by toms 59. Beam side support bracket acts as gusset and bracing to the connections between bearers 58 and 60 and tom 59.

Beamside support bracket 61 acts to transfer load from mould face 54 to main bearer 58 via shear piece 62 which is seen pictorially at lower left or FIG. 27, below a rear elevation, while straight solid arrow shows its positioning onto support bracket 61 by insertion of top 63 and bottom 64 flanges through top 65 and bottom slots 66 (which may advantageously be holes or closed apertures) of beam side support bracket thereby allowing flanges 63 and 64 to be fixed to top and bottom faces of main bearer 58. Two shear pieces are needed for each bracket 61, thereby locking the latter in position in a positive push-pull manner, important not only in resisting live loads of concrete placement but also the stresses involved when the whole arrangement seen in FIG. 27 is used as a flying form, wherein the whole of the form table is stripped (or removed from underneath the suspended slab just cast) and "flown" by crane to its next position on the building without being disassembled to its constituent parts. (Beam depth is altered by changing forms 59 and using different slots 65/66). The type of splayed beam side mould face 54 seen in FIG. 28 may be used to start and end deck formwork wherein beams are to be post-tensioned.

Figure 29:
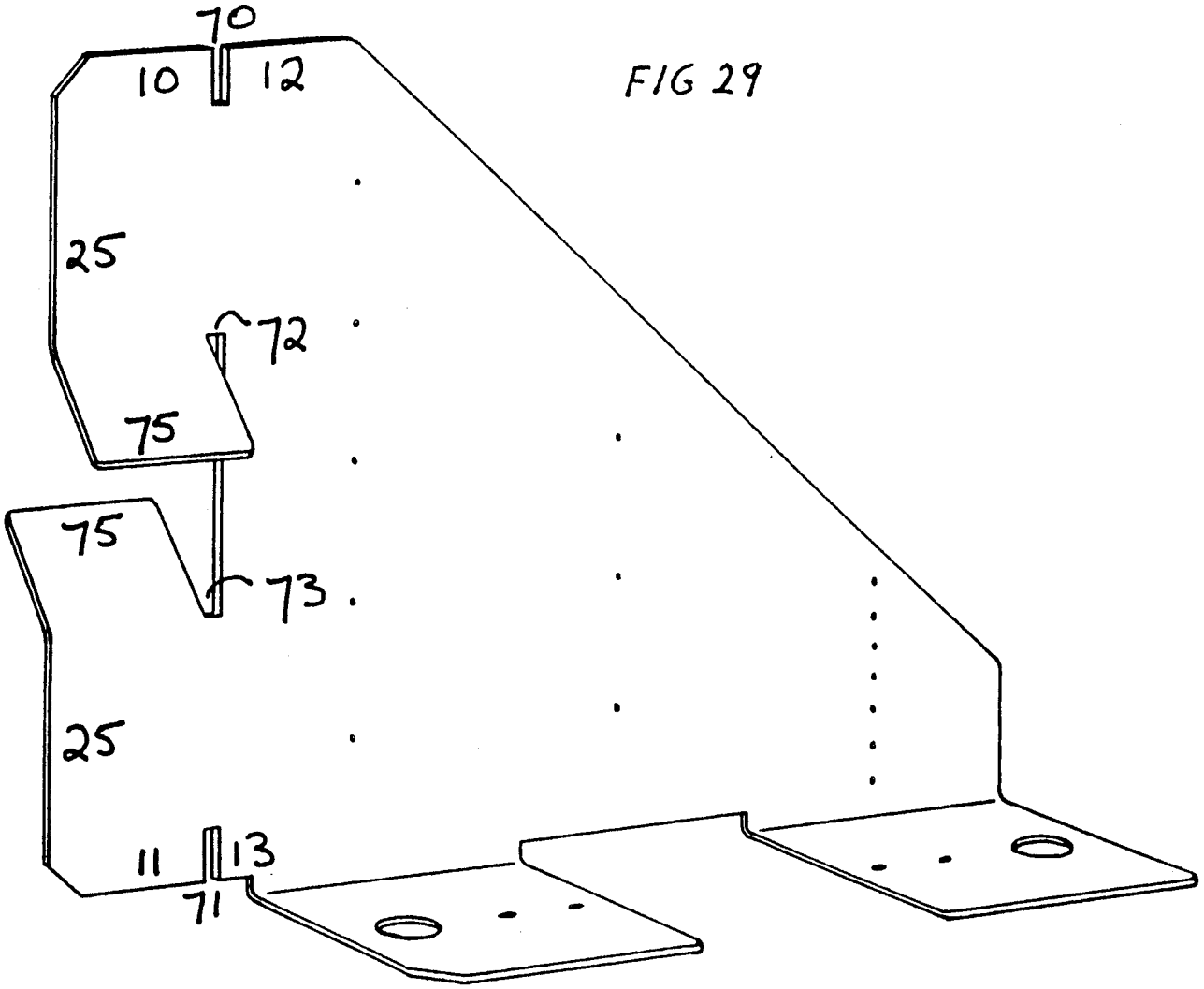
FIG. 29 shows pictorially a single action one-piece dual height edge form support bracket used for supporting pairs of edge forms in tilt-up stack casting.
Figure 30:
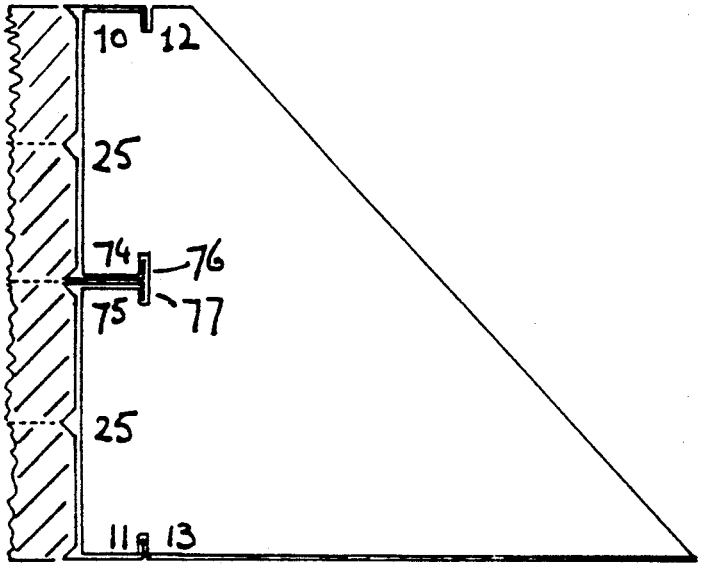
FIG. 30 shows a transverse section of tilt-up stack casting of four panels using a dual height bracket in conjunction with tilt-up edge forms of the types seen in FIGS. 18 and 19.
Figure 31:
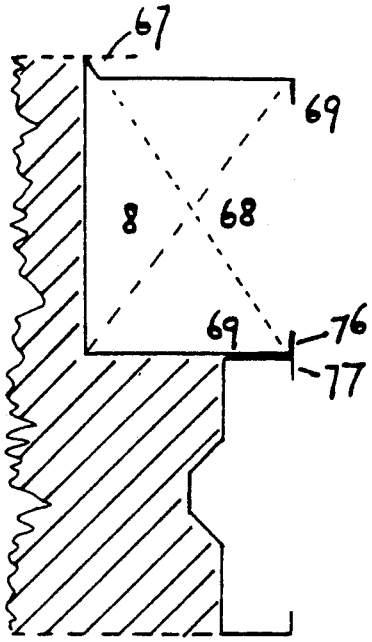
FIG. 31 shows a transverse section of composite modified lipped channel forms corbelled to cast footing base for tilt-up walls.

Stack casting in tilt-up construction requires temporary locking together (FIG. 30) of the type of forms seen in FIGS. 18 and 19 and often it is necessary to mix and match edge forms to obtain a specified footing and joint profile as seen in the corbelled formwork arrangement of FIG. 31. In these cases top and bottom edge forms can be locked together and supported in a single action by a single action dual channel support bracket of the type seen in FIG. 29 wherein fore-end 25 is cut and slotted 72 and 73 and central lugs 74 and 75 thus formed are offset according to rotation considerations discussed above in relation to alignment flanges (but see below). In FIG. 31 the top form overhangs the lower in order to form a weatherproofed base for a tilt-up or brickwork wall whilst the lower form produces a shear key profile for joining of external pavement. Said top form features a vertical protrusion 67 from top flange for carrying a vibrating screed, cavity 8 reinforced by gussets 68 at metre centres represented by broken lines, and refolded double-thickness laminated lips 69; these features adding to safety, strength and ease of use of such relatively large thin walled lipped channels.

Figure 32:
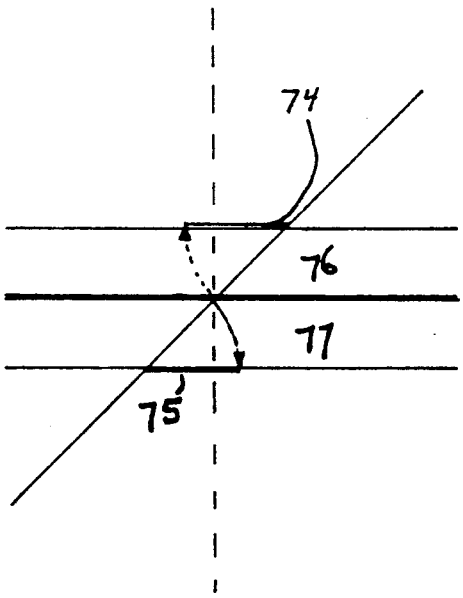
FIGS. 32, 33 and 34 illustrate geometrical considerations of offset engagement is manufacture of single action dual height form supports.
Figure 33:
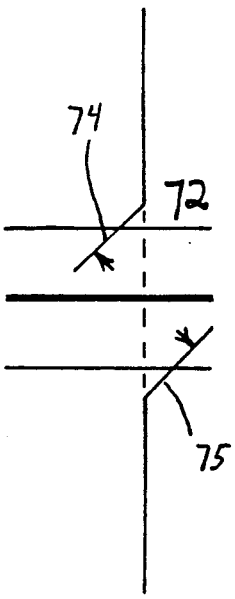
Figure 34:
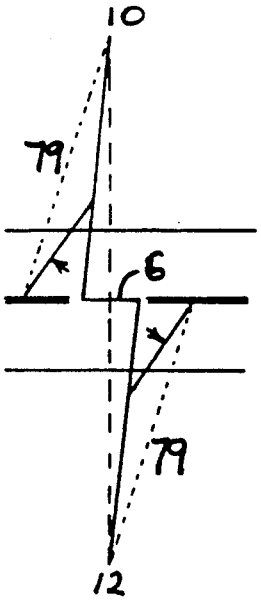

Results of testing show problems can result if care is not taken to ensure central lugs 74 and 75 lock hard onto flanges. Eariler it was mentioned that unwanted vertical movement of forms was controlled by depth of lip housing slots and by housed fore-lugs. FIGS. 32 and 33 which show manufacture detail of the offset geometry involved, show simple cutting and slotting does not allow either top centre lip housing slot 72 or top centre fore-lug 74 to control vertical floating of topmost edge form during placement of vibrated concrete. The curved arrows in FIG. 32 show bending to obtain offset and arrowheads in FIG. 33 show requisite separation to clear edge form lips during rotational assembly/dissambly. There is not material available to form long enough central fore-lugs 74 and 75 from a flat sheet metal bracket body. It is necessary to form a step or zig-zag (seen in rear elevation) in the gussetted body part which then provides extra material for said lugs as seen in FIG. 32. (It is also theoretically possible to serrate fore-lugs to gain length). To further strength fore-lugs it is best to flare 79 fore-end 25 which more or less gussets central fore-lugs back to top 10 and bottom 12 fore-lugs (dotted line).

Figure 35:
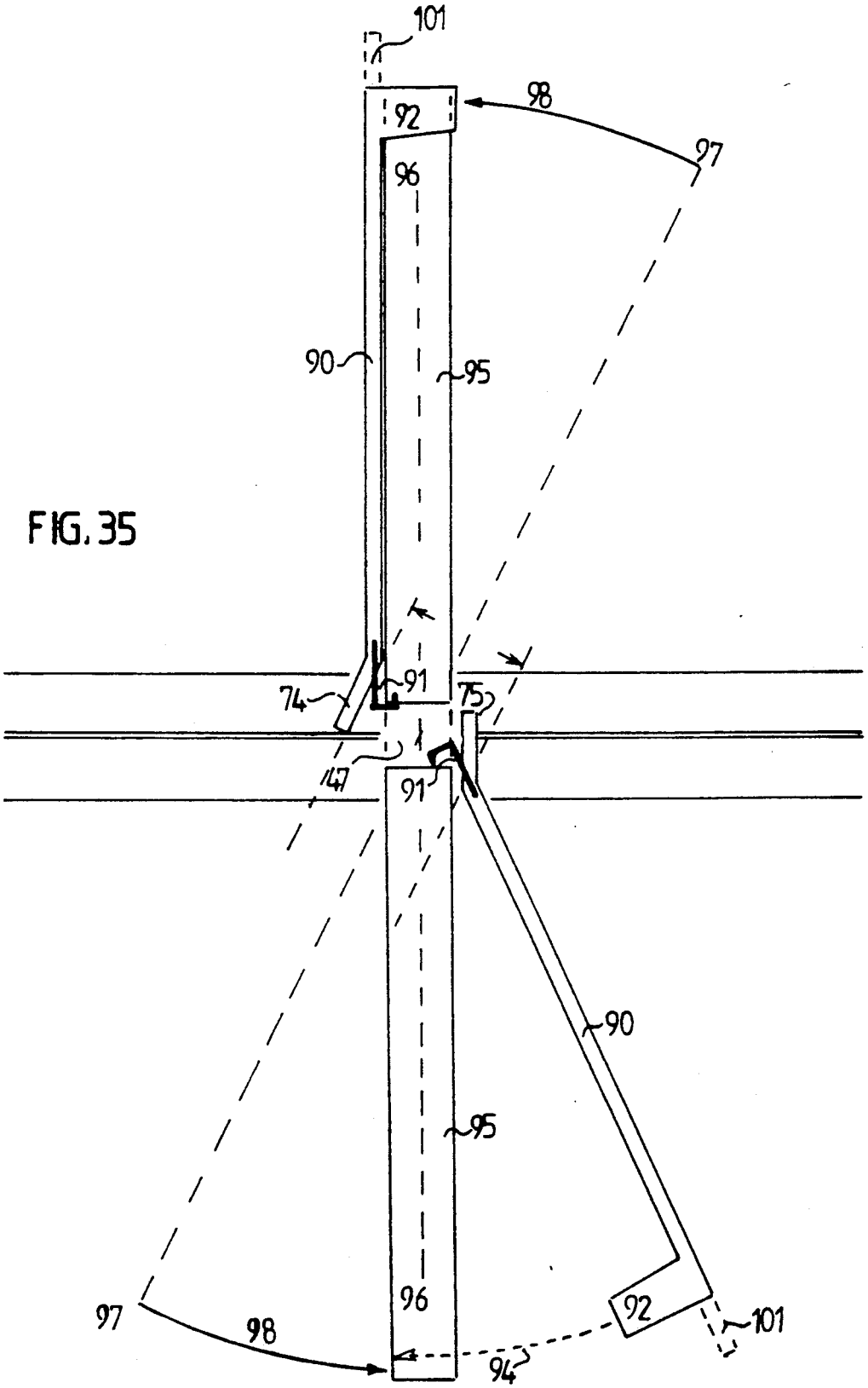
FIG. 35 shows a diagrammatic rear elevation of a different method (separable fore-ends) of achieving said offset engagement geometry.
Figure 36:
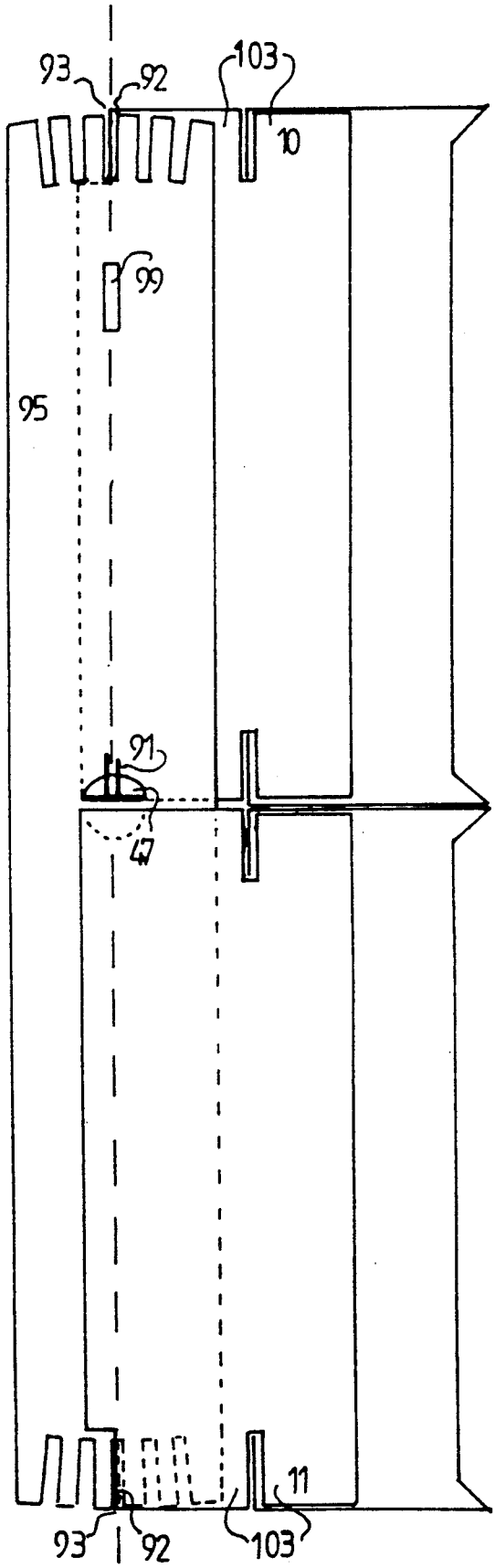
FIG. 36 shows a side elevation of arrangement of such separable fore-ends.
Figure 39:
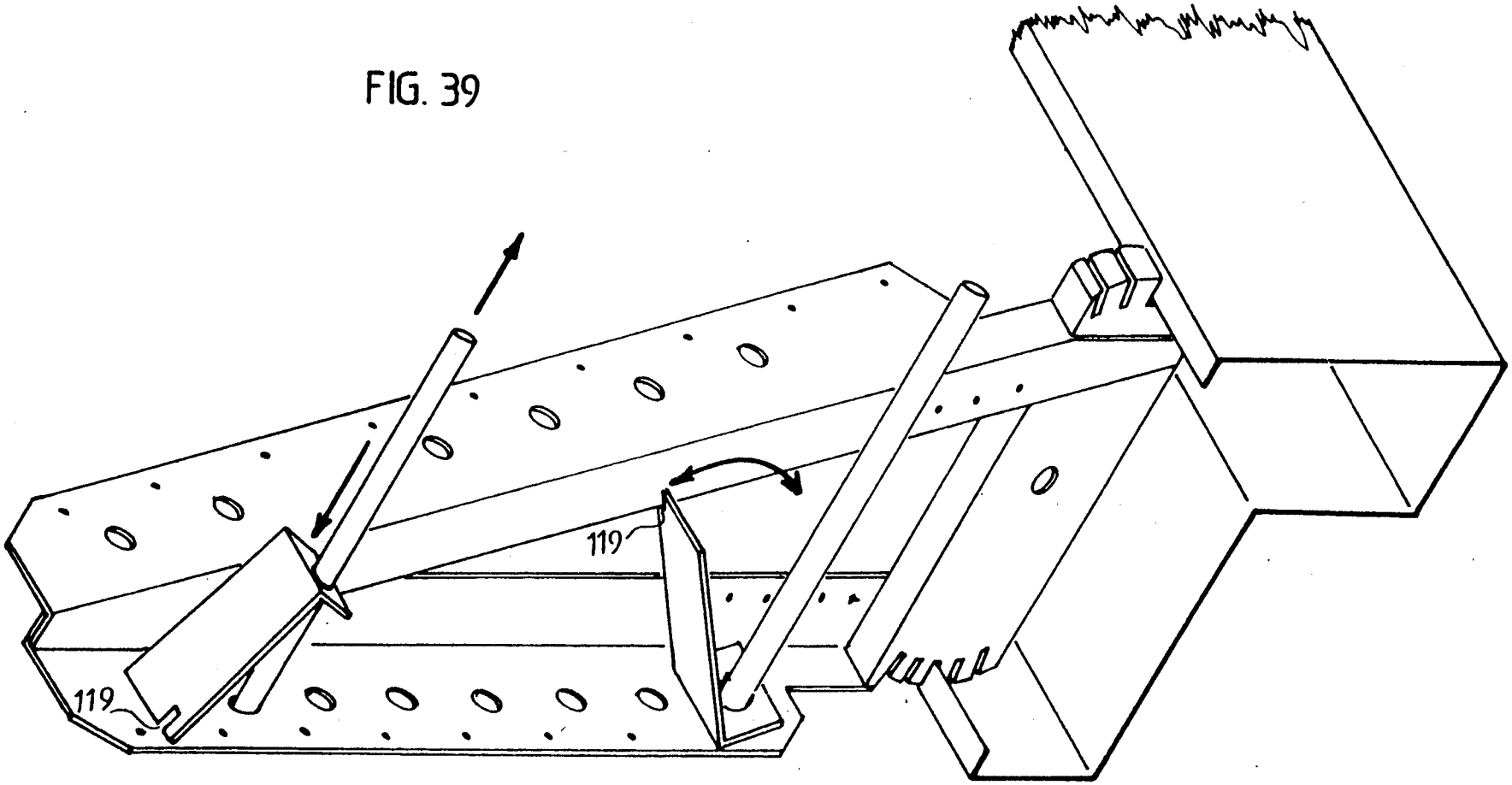
FIG. 39 shows pictorially arrangements of corbelled edge form, support bracket and action of rod clamps on ground spike rods.

Another method of providing said requisite length of central fore-lugs is shown in FIG. 35 by providing separable fore-ends 90 in conjunction with a fabricated support bracket vertical member 95 as seen in FIG. 39. As can be understood from FIGS. 35 and 36, in symmetrical layouts with constant form height, top fore-end 90 is identical with the bottom fore-end, an important advantage in on-site construction. Further, fore-ends of this type may also be used in tilt-up stack casting and precast work, to climb forms up a suitably apertured vertical member without resorting to use of nuts and bolts. In this example—suited to the fabricated bracket of FIGS. 37 and 38 and 39—a central hole 47 (discussed earlier of relation to FIGS. 20 and 21) acts as a receiver for hook means 91; the latter shown being inserted at bottom of FIG. 35 into hole 47. A tapered tab 92 acting as a dummy lip engages tab (or lip) housing slot 93 in end of vertical member 95 when tab end of separable fore-end 90 is rotated in the direction of broken line 94, giving the result seen in the top half of FIG. 35. The taper on inside of tab tightness causing hook means to house securely in its aperture (or in this case centre hole 47). Apart from interchangeability there are here several important points to be made;

(a) tab housing slot 93 may become a spaced system of (closed slots of various shape) apertures such as 99 when separable fore-ends 90 are used in stack-casting to climb forms up a long supported vertical member;

(b) separable fore-ends allow use of different height forms; tab end fore-lugs 10 and 11 need not be at same distance from central aperture 47 as tab housing aperture or slot 93 is, in FIG. 36. This fact is indicated by dotted extensions 101 in FIG. 35;

(c) rotating actions of vertical member 95 in engagment of a pair of lipped channels (shown in rotation from inclined axis 97—97 to vertical axis 96—96 by solid lines 98 in FIG. 35) acts to tighten fore-end tab 92 in its aperture 93;

(d) with a round centre hole 47 it is possible for a support bracket of the type shown in FIGS. 37, 38 and 39 to not only be used adjustably (via radially opposed slots) to engage single complex forms, but also when fitted with extended separable fore-ends 90/101, to engage double channels of a larger size top and bottom, thereby blocking off cave-ins as shown by hatched concrete 102 in FIG. 37. Further said double channels may perform functions seen in FIG. 31 whilst retaining adjustment;

(e) a vernier effect on adjustment may be obtained by suitable radial opposed slotting of fore-lug area 103.

Thin-walled corbel form in FIGS. 37 and 39 is preferably reinforced in cavity 8 shown by dotted lines 104 and edge form lips are preferably double folded. In FIG. 37 form support bracket is anchored firmly to subgrade (ground) 105 shown caved in toward footing trench 106, by rearward ground anchor assembly comprising base plate 14 ground spike rod 107 and non-releasing rod clamp 109, the latter only being capable of release by extraction of rod upward (normal method) or excavation under base plate. Said rod clamp consists of a longer part being base plate bearing segment 110, rod engagement segment 111 (including rod engagement aperture 117) and load transfer means 112 (the latter being a rigid connection) preferably gussetted 113 connecting said bearing and engagement segments. Said clamp acts to brace said rod from rolling rearwardly under loads transferred from bracket fore-end 25 (which as shown in FIG. 39, is constructed in this case from capped Rectangular Hollow Section—RHS—into which radially opposed lip housing slots are formed) by maintaining angular relation between said rod and base plate. Further, said clamp acts to prevent said base plate from lifting off subgrade.

Figure 40:
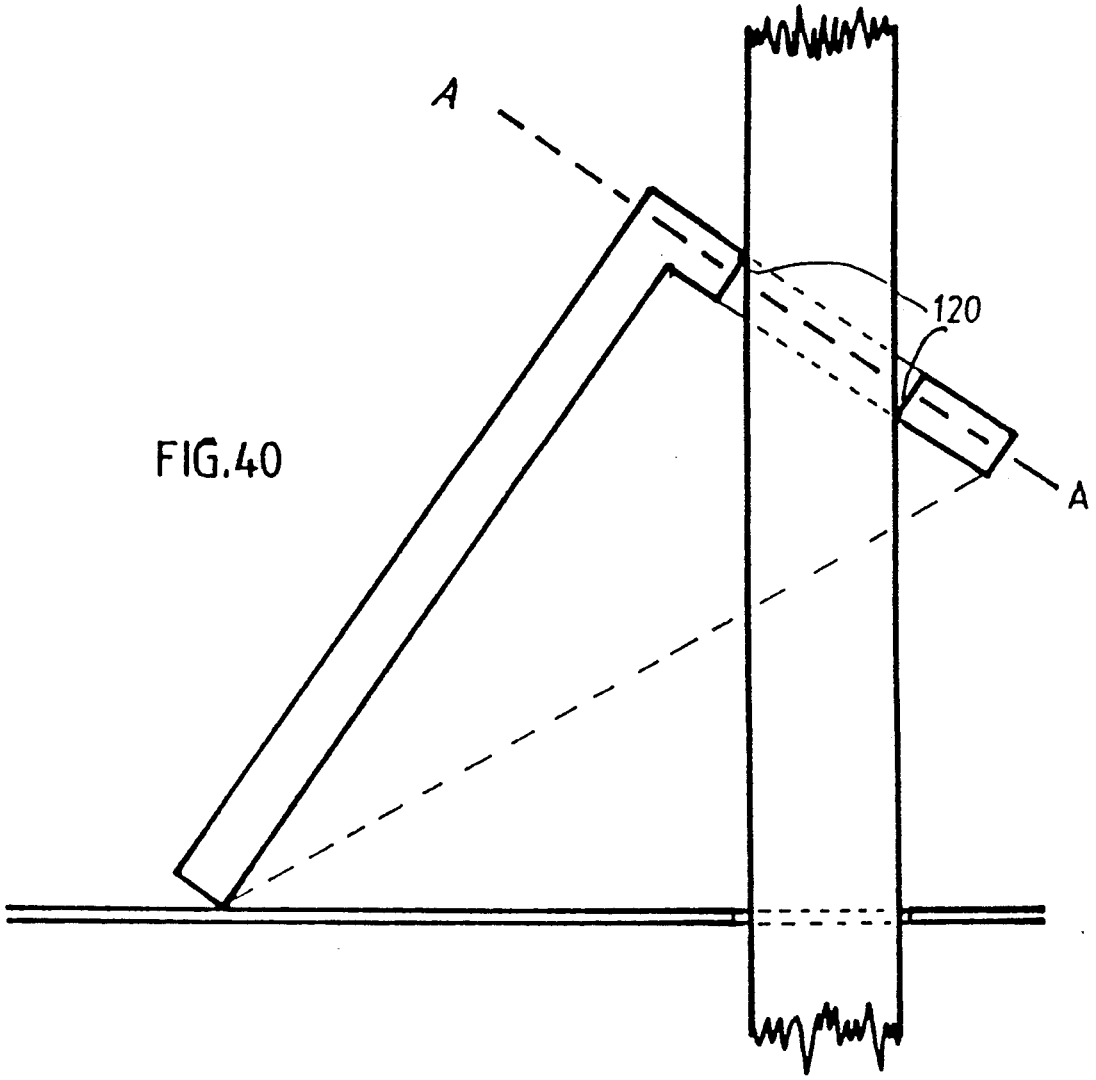
FIG. 40 shows transverse geometry of a rod clamp acting in conjunction with ground spike rod and base plate as a ground anchor assembly.
Figure 41:
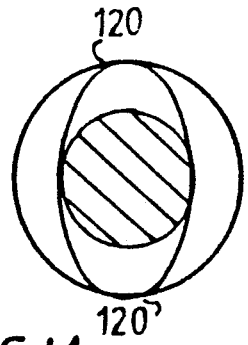
FIG. 41 shows section A—A on circular aperture of said rod and rod clamp seen in the previous figure.
Figure 42:
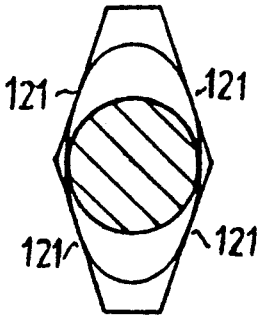
FIG. 42 shows a modified aperture seen in a similar view to the previous figure.
Figure 43:
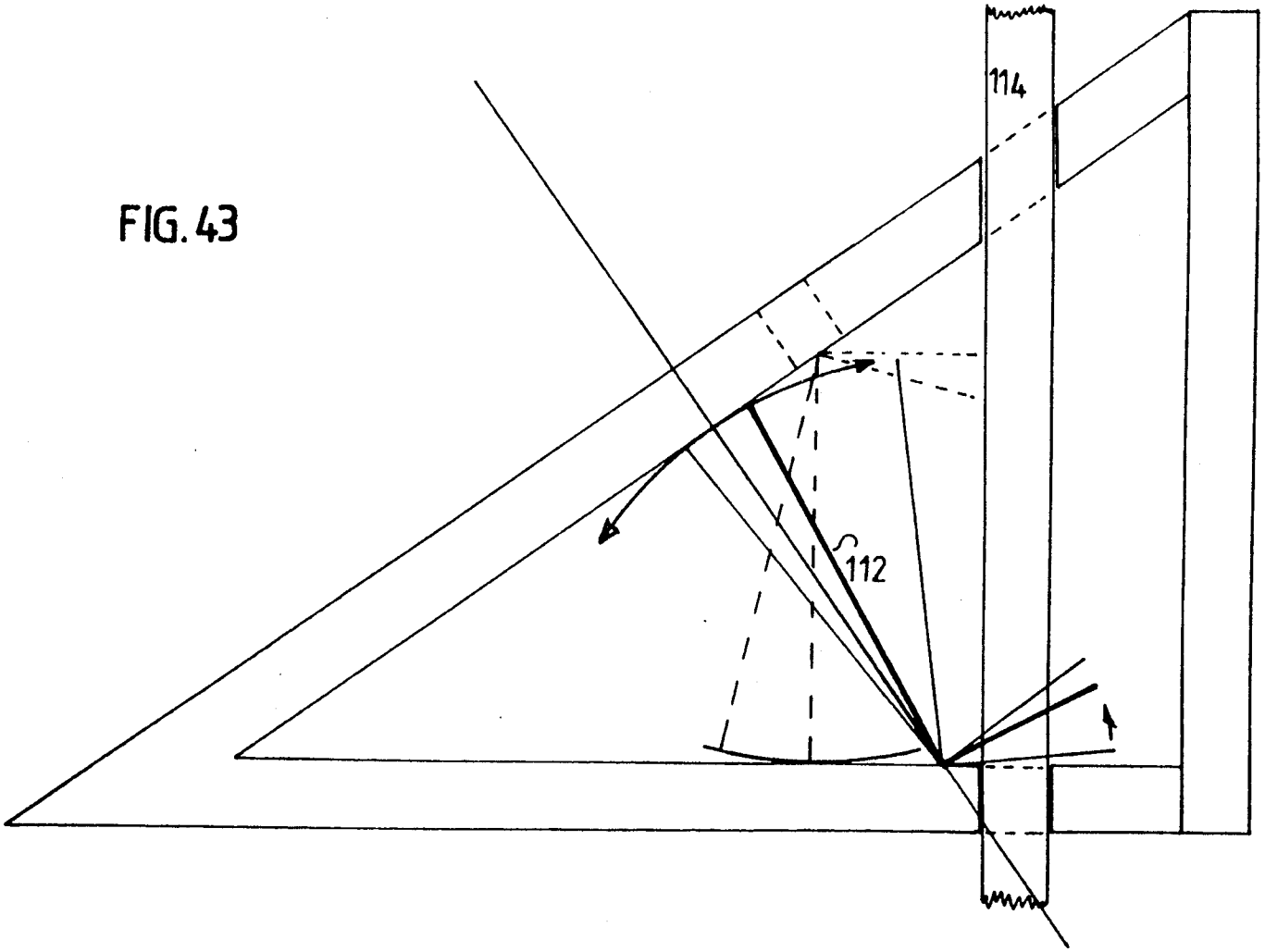
FIG. 43 shows arrangement of geometry in a rod clamp acting to fix position of a hollow triangular body against an intersecting rod, without requiring extraction of said rod for release of said clamp and said triangular body.

Forward ground spike rod 114 carriers cantilevered weight of support bracket and edge form via blocking action of releasable over-centre actioned rod clamp 115 from ground spike rod to lower base plate horizontal flange 14 and vertical flange 116 of (inclined) upper base plate 44, the latter being engaged by a slot 119 formed in free end of the longer part 110. In order to reduce the number of manufactured parts both rod clamps are made identical as shown in FIGS. 37, 38 and 39, and interchangeable by inversion. In operation of releasable, over-centre actioned rod clamp 115, ground spike rod 114 is passed through rod engagement aperture 117 then base plate aperture 17 and driven firmly into subgrade. Said long part 110 of said clamp is then rotated rearwardly and slot 119 engages flange 116 and becomes tight in an over-centre action as rod engagement aperture thrust faces 120 (FIGS. 40, 41 and 42) tighten onto ground spike rod 114. Tapered, thrust faces 121 (FIG. 42) provide more progressive tightening than on-off action of said faces of round hole seen in FIG. 41. Over-centre actions is shown in FIG. 43.

What is claimed is:

1. A form supporting bracket for supporting a concrete form on a support surface, said bracket comprising means for engaging and holding said form, a base plate extending outwardly from said form engaging means and having at least one aperture therein, a rigid support rod extending through said aperture for securing said base plate against lateral movement, and a means for clamping the base plate to the support rod to prevent angular movement of said rod relative to said base plate, said clamping means including a rigid angle member having at least two angle legs, at least one of said angle legs having an aperture through which said support rod extends, the other angle leg being engaged against the base plate.

2. A form supporting bracket according to claim 1, and further comprising a gusset plate extending between said angle legs for strengthening said angle member.

3. A form supporting bracket according to claim 1, and further comprising an upper plate spaced above said base plate such that said other angle leg engages and is wedged between said upper plate and said base plate.

4. A form supporting bracket according to claim 3, wherein said other angle leg includes an open slot at an end thereof distal from the apertured angle leg, said upper plate being received in said slot.

* * * * *